US008814772B2

(12) United States Patent
Mimura et al.

(10) Patent No.: US 8,814,772 B2
(45) Date of Patent: Aug. 26, 2014

(54) SHEET FINISHING APPARATUS AND IMAGE FORMING APPARATUS EQUIPPED WITH THE SAME

(75) Inventors: Hideki Mimura, Minami-Alps (JP); Toshihiro Horii, Kofu (JP); Misao Kobayashi, Kofu (JP)

(73) Assignee: Nisca Corporation, Minamikoma-gun, Yamanashi-ken (JP)

( * ) Notice: Subject to any disclaimer, the term of this patent is extended or adjusted under 35 U.S.C. 154(b) by 820 days.

(21) Appl. No.: 12/585,518

(22) Filed: Sep. 17, 2009

(65) Prior Publication Data

US 2010/0009829 A1 Jan. 14, 2010

Related U.S. Application Data

(62) Division of application No. 11/223,124, filed on Sep. 12, 2005, now abandoned.

(30) Foreign Application Priority Data

Sep. 13, 2004 (JP) ..... 2004-265850
Sep. 13, 2004 (JP) ..... 2004-265851
Sep. 13, 2004 (JP) ..... 2004-265852
Sep. 13, 2004 (JP) ..... 2004-265853

(51) Int. Cl.
*B31F 1/10* (2006.01)
*G03G 15/00* (2006.01)
*B65H 45/14* (2006.01)

(52) U.S. Cl.
CPC ..... *B65H 45/142* (2013.01); *G03G 15/6582* (2013.01); *B65H 2301/17* (2013.01); *B65H 2513/42* (2013.01); *G03G 2215/00877* (2013.01); *B65H 2511/414* (2013.01)
USPC ..... 493/434; 493/416; 493/451

(58) Field of Classification Search
USPC ..... 493/416, 434, 451; 270/32, 58.07
See application file for complete search history.

(56) References Cited

U.S. PATENT DOCUMENTS 5,441,244 A * 8/1995 Bartoes et al. ..... 270/45
5,769,404 A * 6/1998 Kanou et al. ..... 270/37
5,797,596 A * 8/1998 Morigami et al. ..... 270/58.11
5,944,645 A * 8/1999 Kobayashi ..... 493/16
5,993,369 A * 11/1999 Sekita et al. ..... 493/420
6,381,443 B1 * 4/2002 Kawata et al. ..... 399/407
6,436,024 B1 * 8/2002 Kobayashi ..... 493/405
6,592,506 B1 * 7/2003 Lyga ..... 493/424
6,730,010 B2 * 5/2004 Yamakawa et al. ..... 493/267
6,895,212 B2 * 5/2005 Yamakawa et al. ..... 399/407
6,957,810 B2 * 10/2005 Yamada et al. ..... 270/58.08

(Continued)

*Primary Examiner* — Gloria R Weeks
(74) *Attorney, Agent, or Firm* — Manabu Kanesaka

(57) ABSTRACT

A sheet finishing apparatus includes a first conveyance path connected to a sheet conveyance inlet, a second conveyance path branching from the first conveyance path, a folding roller device disposed in the second conveyance path for folding the sheet, and a sheet discharge path arranged vertically parallel to the second conveyance path and guiding the folded sheet from the second conveyance path to a sheet conveyance outlet. The second conveyance path includes a first guide path located at a downstream side relative to the folding roller device and guiding a rear side of the sheet, and a second guide path located at an upstream side relative to the folding roller device and guiding a front side of the folded sheet conveyed from the folding roller device. A gate is formed for selectively guiding the folded sheet from the second guide path to the storage device or the sheet discharge path.

6 Claims, 38 Drawing Sheets

(56) References Cited

U.S. PATENT DOCUMENTS

| | | | | |
|---|---|---|---|---|
| 7,040,612 | B2 * | 5/2006 | Garner et al. | 270/8 |
| 7,052,005 | B2 * | 5/2006 | Yamakawa et al. | 270/37 |
| 2002/0086786 | A1 * | 7/2002 | Kamizuru et al. | 493/405 |
| 2002/0117793 | A1 * | 8/2002 | Hosoya et al. | 270/4 |
| 2003/0155699 | A1 * | 8/2003 | Tamura et al. | 270/52.01 |
| 2003/0227121 | A1 * | 12/2003 | Yamakawa et al. | 270/37 |
| 2004/0185993 | A1 | 9/2004 | Doi | |
| 2004/0254054 | A1 * | 12/2004 | Suzuki et al. | 493/405 |

* cited by examiner

SHEET FINISHING APPARATUS AND IMAGE FORMING APPARATUS EQUIPPED WITH THE SAME

CROSS-REFERENCE TO RELATED APPLICATION

This is a divisional application of Ser. No. 11/223,124 filed on Sep. 12, 2005.

BACKGROUND OF THE INVENTION AND RELATED ART STATEMENT

The present invention relates to a sheet finishing apparatus that creates booklets of sheets formed with images by an image forming apparatus, such as a printer, and then discharges the booklets therefrom, or that folds the sheets twice or three times according to a desired method of filing. The invention also relates to an image forming apparatus equipped with the sheet finishing apparatus.

A sheet processing apparatus, such as the type described above, is generally used as an apparatus for folding sheets discharged from a printing machine or printer, or for conveying the folded sheets to a finishing apparatus for binding. Many of such apparatuses are connected to an image forming apparatus, such as a printer. The apparatuses are widely used as a printing system that can perform continuous operations of processes from printing to booklet-making by discharging sheets after a folding process, or feeding sheets to a finishing apparatus for a binding procedure, such as stapling.

Conventionally, the type of sheet finishing apparatuses described above have a pair of folding rollers in mutual contact in a path for conveying a sheet. The sheet is folded into two by feeding a folding position of the sheet conveyed in the conveyance path nipped between these folding rollers. Still further, the sheet can be folded into three or four by feeding rollers established at a downstream side. When folding a sheet using a pair of folding rollers, it is necessary to accurately calculate the folding position of the sheet. If the sheet folding position is incorrect or skewed, accurate folding is not possible, and the sheet can become wrinkled.

In the prior art, Japanese Patent Publication (JP) 2004-99199 discloses a method of inserting a folding blade at a folding position, while the leading edge of a sheet fed at a conveyance path engages a stopper and is stationary, so as to press the folding position of a sheet into folding rollers. In this method, the sheet is temporarily stopped in the conveyance path, at which point the knife-edge-shaped folding blade presses at a predetermined folding position of the sheet positioned at a stopper. This method for positioning the folding position of a sheet at the folding rollers is comparatively accurate. But, this type of folding process requires additional time because the sheet is temporarily stopped in the conveyance path, and the folding blade must move into a contact position with the folding rollers from a position retracted from the conveyance path.

Also disclosed in JP 2004-99199 is a structure for guiding a sheet with one end folded from the folding rollers into a conveyance path, and for folding the other end of the sheet to form a so-called letter fold at the conveyance path. This structure employs a stopper for engaging an end (i.e., a leading edge) of the sheet in the conveyance path, and two folding rollers for folding the other end of the sheet. With this structure, the leading edge of the sheet folded by a first pair of folding rollers engages the stopper. Then, the trailing edge of the sheet is fed from the first pair of folding rollers into a second pair of folding rollers. That is, the system calculates the folding position by pressing a stationary sheet positioned at a stopper into the first pair of folding rollers using a folding blade, and calculates the folding position by feeding the trailing edge of the sheet to the second pair of folding rollers, while the leading edge is engaged and pressing through a pair of folding rollers.

But, a method that calculates a folding position by engaging a leading edge of a sheet at a stopper requires that the stopper position be moved to adjust both for the sheet length, and for the method of folding the sheet, such as two or three folds.

Japanese Patent Publication (JP) 2003-118932 arranges conveyance rollers separated a distance on a conveyance path, and disposes folding rollers between these rollers in front and behind. Then, while one roller nips and holds the sheet stationary, another roller feeds the sheet into the folding rollers to perform the folding process. To apply a second fold to the sheet, second folding rollers are arranged at a discharge side, and conveyance rollers are arranged at a downstream side of these folding rollers. These conveyance rollers nip and stop a sheet folded by the first folding rollers, and bend to feed the sheet in this state into the second folding rollers. In other words, the first and the second folding rollers are arranged sequentially in the conveyance path. The sheet is fed into the folding rollers while a predetermined position of a leading edge side in a direction of sheet conveyance is nipped and stopped by conveyance rollers, and the sheet is bent. After the folding rollers feed in the sheet, the folding position is formed by reversing the conveyance rollers positioned at a downstream side.

To apply two or three folds to a sheet discharged from an image forming apparatus, such as the apparatus described in JP 2004-99199, a conveyance path normally includes first and second folding rollers. Either a leading edge of the sheet is engaged by a stopper to calculate the folding position, or, as described in JP 2003-118932, forward and reverse driving rollers for nipping a sheet are disposed at a downstream side of first and second folding rollers. The folding position is determined by stopping the rollers.

However, to apply a second or more folds to a sheet, the methods for calculating the folding positions are different, as described below, for the first and the second folding rollers. A method of engaging a leading edge of a sheet at a stopper is used to calculate a folding position for the first folding rollers. In that method, the stopper moves to a prescribed position in the path according to the sheet-length. Then, the folding proceeds, such as, for example, applying two or three folds. Compared to the stopper for calculating the folding position of the second folding rollers where one end is already folded, the stopper for calculating the folding position of the first folding rollers must be movable for a longer distance, making the device more complex. At the same time, the distance between the first folding rollers and stopper change according to the sheet size. When a long sheet is supportingly guided by a conveyance guide for a long distance, it becomes unstable, which invites skewing problems in the folding position (i.e., the position fed into the first folding rollers) or wrinkle formation in the sheet.

Conversely, by using conveyance rollers to position a folding position at the first folding rollers, a comparatively stable folding position can be attained regardless of the length of a sheet. However, the following problems occur when positioning a folding position using conveyance rollers and employing the second folding rollers.

In other words, because one end of a sheet guided to the second folding rollers is already folded, the folded sheet is fed in one direction while conveyance rollers nip the sheet. At a predetermined position these rollers stop, and feed the sheet by reversing when the trailing edge of the sheet is being fed into the second folding rollers. For that reason, the pair of rollers drives in a forward and a reverse direction while nipping the folded sheet. When the folding position of the once folded sheet is nipped by the rollers, a double fold occurs, causing wrinkles to be formed in the sheet fold.

Thus, in the prior art, either a stopper is engaged for the folding position of the first or the second folding rollers, or a sheet is controlled by conveyance rollers. Use of these prior art methods can, however, result in the above-described problems.

In view of the aforementioned problems associated with the prior art, a first object of the present invention is to provide a sheet finishing apparatus having both a compact and simple structure, and having a mechanism for accurately positioning a sheet at the first folding rollers when applying two or three folds to a sheet. A related object of the invention is to provide a sheet finishing apparatus that can apply comparatively accurate folds to the sheet with a mechanism for positioning a folded sheet at the second folding rollers, yet without destroying a previous folded position or causing wrinkles in the fold.

A second object of the present invention is to provide a sheet finishing apparatus that can easily calculate a folding position according to folding conditions, such as, for example, sheet folding procedures or sheet length. A related object of the invention is to provide a sheet finishing apparatus in which discrepancies in sheet or conveyance do not affect the folding position.

A third object of the present invention is to provide an image forming apparatus equipped with a sheet finishing apparatus that accurately folds sheets.

Further objects and advantages of the invention will be apparent from the following description of the invention and the associated drawings.

SUMMARY OF THE INVENTION

The present invention employs the following configuration to attain the objects described above.

In a first aspect, first and second conveyance means are arranged at a prescribed distance in a sheet conveyance path. First folding roller means are arranged between the first and second conveyance means. A folded sheet conveyance path branches from the conveyance path for conveying a folded sheet from the first folding roller means, and second folding roller means are disposed in the folded sheet conveyance path. The second conveyance means comprise a roller means pair that is capable of both forward and reverse drive for nipping conveyance of a sheet.

Aligning means are disposed for aligning a trailing edge of a sheet in a conveyance path. The aligning means allow a sheet conveyed by the first conveyance means to pass, then, enable the trailing edge of a sheet reversingly conveyed by a reverse drive of the roller means to engage and stop.

The present invention includes a stopper member to engage and align a leading edge of a folded sheet conveyed from the first folding roller means. The stopper member comprises a swingable lever member having a rotating shaft at a curved side of a curved guide member. A sheet is fed from the first conveyance means to the first folding roller means after the roller means aligns a leading edge of the sheet. The sheet is then fed from the first folding roller means to the second folding roller means after a trailing edge engages a stopper member, and is positioned and aligned.

Because a folding point can be positioned using forward and reverse drives of a pair of conveyance rollers arranged near the first folding rollers, one end of a sheet (i.e., the leading end) can be engaged by a stopper in a guide path, thereby allowing the apparatus to be simplified and relatively small. In addition, because a folding point can be positioned by a stopper that engages a leading edge at the second folding rollers, it is possible to create a predetermined folding position instead of positioning by nipping the sheet using rollers. The present invention, therefore, minimizes the possibility of forming a double fold, or wrinkles, in the sheet.

In order to attain the second object of the present invention, the following configuration is employed.

Specifically, first and second conveyance means are disposed at a prescribed distance in a sheet conveyance path, folding roller means are disposed between the first and the second conveyance means, and a folded sheet conveyance path branches from the conveyance path for conveying a sheet from the folding roller means. The configuration enables a second conveyance means to reverse the conveyance of a sheet on the conveyance path using a roller pair that is capable of both forward and reverse drives. Also, in the sheet conveyance path, first stopper means are disposed at a downstream side of the folding roller means, and second stopper means are disposed at an upstream side. The first stopper means position a leading edge of the sheet, and guide the sheet fed by the first conveyance means to the folding rollers. The second stopper means position a trailing edge of the sheet, and guide the sheet reversingly conveyed by the second conveyance means to the folding roller means.

The first stopper means comprises a roller pair capable of both forward and reverse drives. The drive means for this roller pair has a control means for nipping a predetermined position of a sheet so as to stop the sheet based on the sheet's length. The second stopper means projects into the conveyance path, and comprises a stopper member for engaging a trailing edge of a sheet reversingly conveyed by a reverse drive of the second conveyance means. The stopper means allows a sheet conveyed by the first conveyance means to pass, then engage the trailing edge of a sheet reversingly conveyed by a reverse drive of the second conveyance means. Second folding roller means are arranged in the folded sheet conveyance path.

According to the embodiment of the invention described above, first stopper means are disposed at the downstream side of the folding roller means, second stopper means are disposed at the upstream side of the folding roller means, and sheets are folded using the folding roller means arranged in the sheet conveyance path. The sheet is guided with the leading edge (i.e., leading end) as a reference at the first stopper means, and is guided with the trailing edge (i.e., trailing end) as a reference at the second stopper means. Thus, it is possible to set the calculated folding position from the sheet leading edge based on paper folding conditions, such as the sheet folding procedures and the sheet length, or on the sheet trailing edge. This provides a system in which the differences in sheet size, or any discrepancy in conveyance amounts, will not affect the determination of the folding position.

It is thus possible to incorporate in an image forming apparatus a sheet finishing apparatus that attains the aforementioned advantages.

BRIEF DESCRIPTION OF THE DRAWINGS

FIG. 2(*b*) illustrates an accordion fold formed by the sheet finishing apparatus according to the present invention.

FIG. 2(*c*) illustrates a double parallel, or gate, fold formed by the sheet finishing apparatus according to the present invention.

FIG. 6(*a*) is a perspective view of a sheet pressing guide in which the pressing solenoid is ON.

FIG. 6(*b*) is a perspective view of the sheet pressing guide in which the pressing solenoid is OFF.

FIG. 7(*b*) is a sectional view of the sheet pressing guide, and illustrates the pressing of the sheet.

FIG. 8(*b*) is a sectional view of the sheet trailing edge stopper in which the stopper is positioned inside of the conveyance path.

FIG. 11(*b*) is view of the registration SB roller drive transmission system mechanism in which the solenoid is ON and the clutch is engaged.

FIG. 13(*b*) is a view of the flow of operations for a letter fold, and illustrates a second step in the first folding format.

FIG. 13(*c*) is a view of the flow of operations for a letter fold, and illustrates a third step in the first folding format.

FIG. 13(*d*) is a view of the flow of operations for a letter fold, and illustrates a fourth step in the first folding format.

FIG. 13(*e*) is a view of the flow of operations for a letter fold, and illustrates a first step in a second folding format.

FIG. 13(*f*) is a view of the flow of operations for a letter fold, and illustrates a second step in the second folding format.

FIG. 13(*g*) is a view of the flow of operations for a letter fold, and illustrates a first step in a discharge format to a storage box.

FIG. 13(*h*) is a view of the flow of operations for a letter fold, and illustrates a second step in the discharge format to the storage box.

FIG. 14(*b*) is a view of the flow of operations for an accordion fold, and illustrates a second step in the first accordion folding format.

FIG. 14(*c*) is a view of the flow of operations for an accordion fold, and illustrates a third step in the first accordion folding format.

FIG. 14(*d*) is a view of the flow of operations for an accordion fold, and illustrates a fourth step in the first accordion folding format.

FIG. 14(*e*) is a view of the flow of operations for an accordion fold, and illustrates a first step in a second accordion folding format.

FIG. 14(*f*) is a view of the flow of operations for an accordion fold, and illustrates a second step in the second accordion folding format.

FIG. 14(*g*) is a view of the flow of operations for an accordion fold, and illustrates a first step in an accordion fold discharge format to a storage box.

FIG. 14(*h*) is a view of the flow of operations for an accordion fold, and illustrates a second step in the accordion fold discharge format to the storage box.

FIG. 15(*b*) is a view of the flow of operations for a double parallel, or gate, fold, and illustrates a second step in the first double parallel folding format.

FIG. 15(*c*) is a view of the flow of operations for a double parallel, or gate, fold, and illustrates a third step in the first double parallel folding format.

FIG. 15(*d*) is a view of the flow of operations for a double parallel, or gate, fold, and illustrates a fourth step in the first double parallel folding format.

FIG. 15(*e*) is a view of the flow of operations for a double parallel, or gate, fold, and illustrates a first step in a second double parallel folding format.

FIG. 15(*f*) is a view of the flow of operations for a double parallel, or gate, fold, and illustrates a second step in the second double parallel folding format.

FIG. 15(*g*) is a view of the flow of operations for a double parallel, or gate, fold, and illustrates a first step in a double parallel discharge format to a finishing unit.

FIG. 15(*h*) is a view of the flow of operations for a double parallel, or gate, fold, and illustrates a second step in the double parallel discharge format to the finishing unit.

FIG. 15(*i*) is a view of the flow of operations for a double parallel, or gate, fold, and illustrates a third step in the double parallel discharge format to the finishing unit.

FIG. 15(*j*) is a view of the flow of operations for a double parallel, or gate, fold, and illustrates a fourth step in the double parallel discharge format to the finishing unit.

DETAILED DESCRIPTION OF THE PREFERRED EMBODIMENTS

Figure 1:
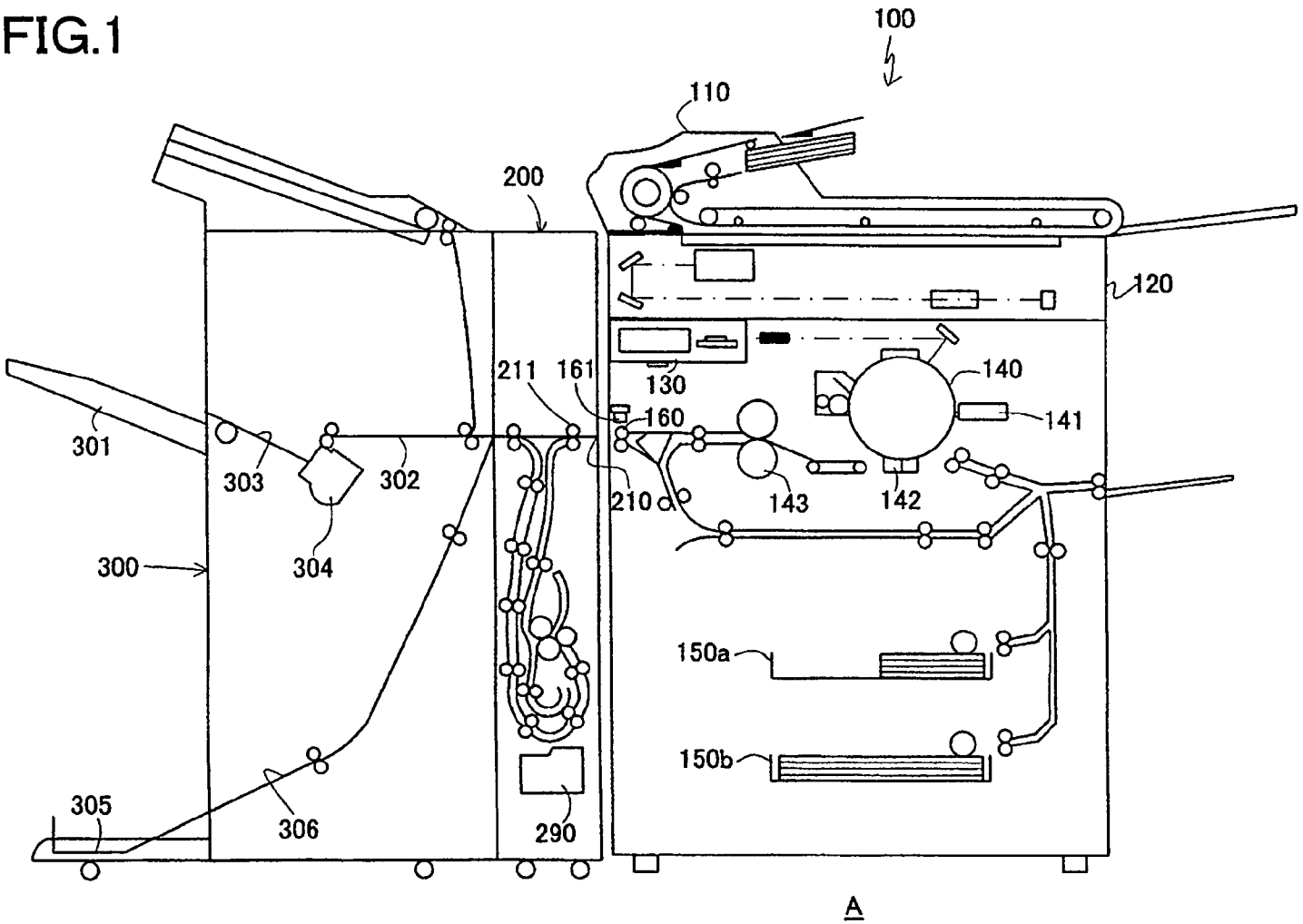
FIG. 1 is a sectional view of one embodiment of an image forming system according to the present invention.
Figure 2A:
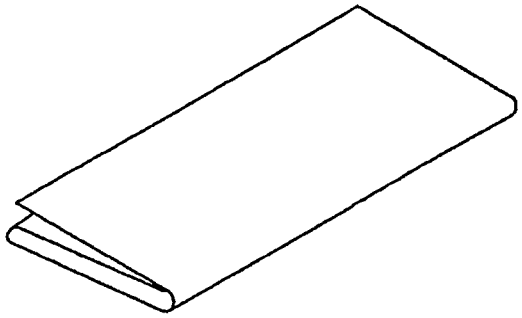
FIG. 2(*a*) illustrates a letter fold formed by a sheet finishing apparatus according to the present invention.
Figure 2B:
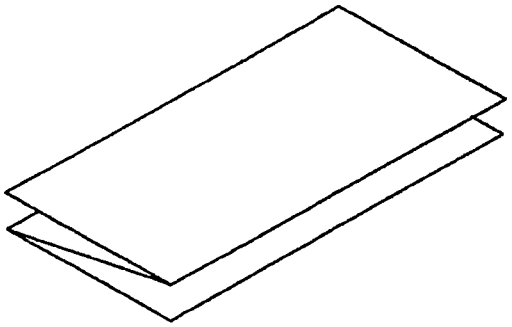
Figure 2C:
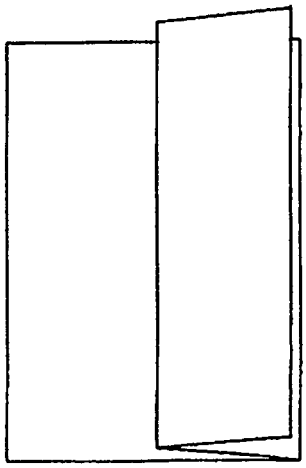
Figure 3:
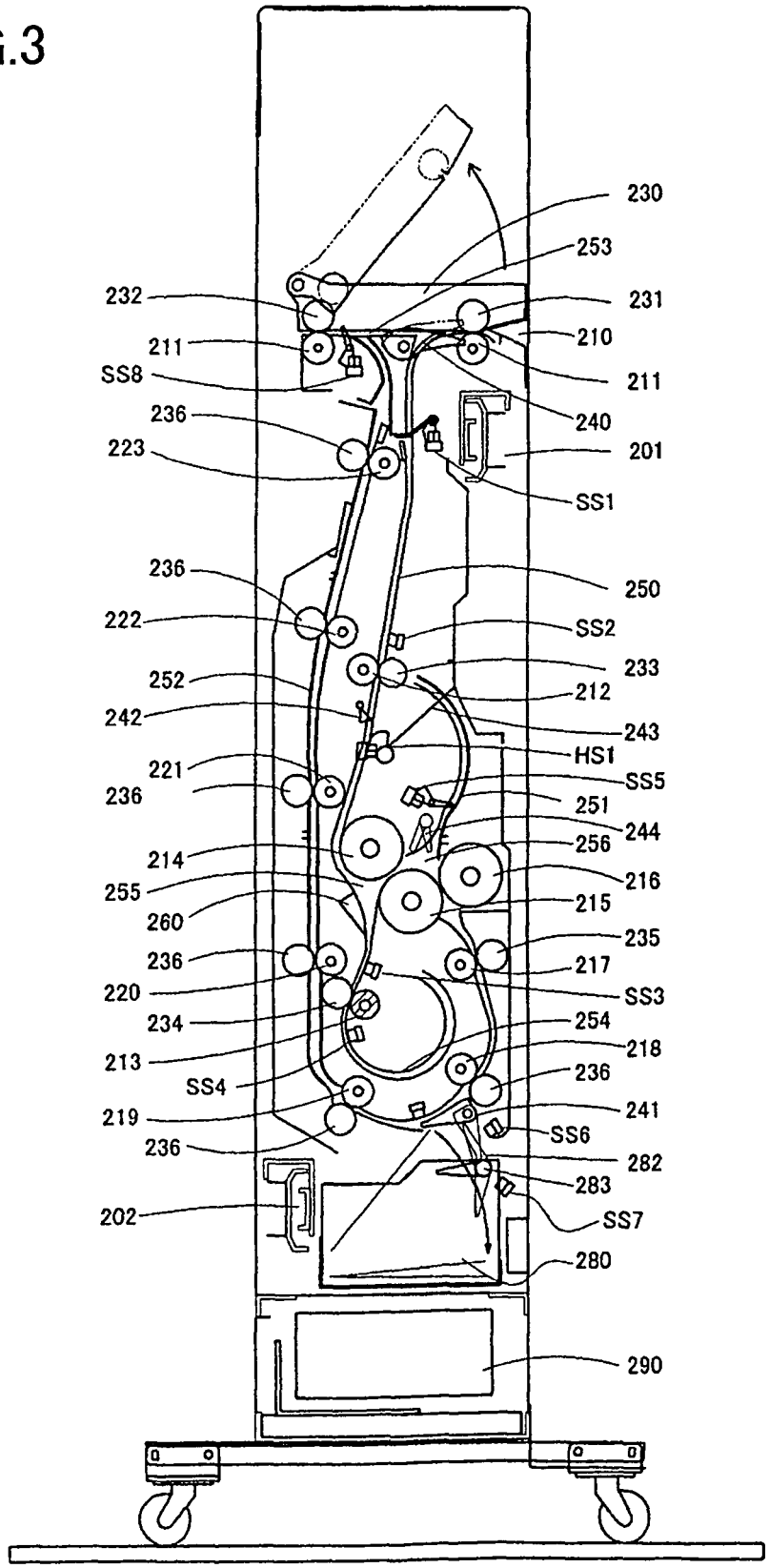
FIG. 3 is a structural view of an entire paper folding unit.

The preferred embodiments of the present invention will be explained with reference to the accompanying drawings. FIG. 1 illustrates an image forming apparatus that employs a sheet finishing apparatus according to the present invention. FIGS. 2(*a*)-2(*c*) illustrate a folding procedure (i.e., a paper folding format) using a sheet finishing apparatus. FIG. 3 illustrates the overall configuration of the sheet finishing apparatus.

The following will describe the entire system of the image forming apparatus that employs the present invention. FIG. 1 shows an image forming apparatus A equipped with an image forming unit 100; a sheet finishing unit 200 (hereinafter referred to as a paper folding unit) for folding sheets formed with images and conveyed from the image forming unit 100; and a finishing unit 300 for finishing sheets, such as by binding them using staples, conveyed from the paper folding unit 200. The image forming unit 100 is embedded with a printing unit including an ink jet, an electrostatic drum and an offset drum. This unit can be configured by either a copier for printing images read by a scanner 120 onto a sheet at a printing unit, or a printer that prints image data sent from a data forming device, such as a personal computer, onto a sheet.

The paper folding unit 200 is equipped with a folding mechanism for folding sheets formed with images at the image forming unit 100 and sequentially conveyed therefrom, into two or three folds. The paper folding unit 200 folds sheets after the image forming process according to the binding or filing conditions. The finishing unit 300 is connected to the discharge outlet of the paper folding unit 200. The finishing unit 300 receives sheets that have been folded or non-folded sheets for finishing by stapling or punching holes therein. Then, the finishing unit 300 stores sheets in a final discharge stacker.

There is a wide variety of structures for the print finishing system described above. The following will describe an example of the image forming unit and the finishing unit according to FIG. 1. The image forming unit 100 shown in the drawing is a copying device. The image forming unit 100 comprises an original feeding unit (ADF) 110 for feeding originals; the scanner unit 120; and an image forming unit 130. The original feeding unit 110 sequentially separates a series of originals stacked on a stacker to a platen on the scanner unit 120. After the scanner unit 120 reads the original, a regular document feeder stores the original in a discharge stacker.

The image data read by the scanner unit 120 is processed and sent to the image forming unit 130. The image forming unit 130 radiates laser light onto the photosensitive drum 140 according to the received image signals. An electrostatic latent image is formed on the photosensitive drum 140 by the irradiated laser light. Then, a toner image is developed of the electrostatic latent image by the developer 141. This toner image is transferred by the transfer charge 142 to the sheet such as an original fed from the paper feed cassette 150*a* or 150*b*. The sheet PA transferred with the toner image is treated by a fixer 143 to fix that toner image on the sheet. The treated sheet PA is conveyed to the paper folding unit 200 connected by discharge rollers 160 at the main unit.

A discharge outlet sensor 161 at the main unit detects the discharge of the sheet PA. This sends a discharge signal ES from the CPU on the main unit to the paper folding unit control unit 290 of the paper folding unit 200. The paper folding unit control unit 290 of the paper folding unit 200 receives the operation timing with the discharge signal ES from the image forming unit 100. The paper folding unit control unit 290 judges the processing of the sheet conveyed to the sheet conveyance inlet 210 by the size signal DS and the folding mode signal FS.

Conveyance paths are separated by an input conveyance gate 240 (see FIG. 3) disposed directly behind a sheet input conveyance roller 211. This input gate 240 sorts the sheets PA conveyed by the sheet input conveyance roller 211 at the inlet of the paper folding unit 200. If a folding process is not specified, the sheet PA simply passes over the paper folding unit 200 at a fourth conveyance path 253 (FIG. 3) formed by a pinch roller unit 230 (FIG. 3) comprising pinch rollers 231 (FIG. 3) and 232 (FIG. 3) above the paper folding unit 200, and is fed directly into the finishing unit 300.

If the folding process is specified, the sheet PA is fed into a first conveyance path 250 (FIG. 3) for conveying into the paper folding unit 200. Size signals SS and a feeding mode signal FS information perform the folding process according to the selected folding method for either a letter fold, an accordion fold (or z-fold), or double parallel (or gate). In the event that a letter fold is selected, the folded sheet PA is stored and stacked in the folded sheet storage box 280 (FIG. 3) inside the paper folding unit 200. If other folding processes are selected, the sheet PA passes through a third conveyance path 252 (FIG. 3) after the folding process, and merges into the fourth conveyance path 253 and is fed into the finishing unit 300. There, another finishing process, such as binding or hole punching, is performed on the sheet PA.

The finishing unit 300 is installed with a link to the conveyance outlet of the paper folding unit 200. The finishing unit 300 performs a variety of processes on the sheets conveyed from the paper folding unit 200, including stapling, punching holes or applying stamps. The finishing unit 300 is disposed with a sheet conveyance inlet at a sheet conveyance outlet of the paper folding unit 200. A finishing mechanism (e.g., a stapler) 304 is arranged for finishing sheets at a conveyance path 302 between the sheet conveyance inlet and a sheet storage stacker 301. The drawing shows the binding of sheets with a stapler as a finishing mechanism. A staple tray 303 for holding sheets, and the stapler 304 that uses staples to bind a sheet bundle stacked on the staple tray 303 are arranged on the conveyance path 302.

A variety of mechanisms are well-known for use as the stapler 304. Either of those mechanisms can be employed in the present invention. Furthermore, instead of using the stapler 304, it is also perfectly acceptable to incorporate a gluing device for gluing a side of sheets, a punching device for punching holes in the sheets, or a stamping device for applying a predetermined stamp on the sheets. That is, either of these mechanisms can be incorporated in the conveyance path 302 according to the specifications for the finishing unit 300.

FIG. 1 also illustrates a second storage stacker 305. Second storage stacker 305 stores folded sheets from the paper folding unit 200 via a discharge path 306 when the finishing of sheets is not required.

The paper folding unit 200 is described below with reference to FIG. 1. The types of folds normally required with an image forming apparatus are a single fold, an accordion fold, a letter fold, and a double parallel, or gate, fold. The following will describe each of these types of folds.

Single Fold

A single fold folds a sheet conveyed from the image forming unit 100 at a halfway position in the length of the sheet conveyance direction. Thus, a sheet is folded in half at a center position. It is then possible to create a bound document by stapling or by gluing together the folded ends of folded sheets. A single folded sheet can also be used in a variety of ways to organize documents. An example includes filing by punching holes in the sheets. In such cases, a sheet conveyed from the image forming unit 100 is folded at a halfway position by folding rollers arranged in a conveyance path. Therefore, a pair of sheet folding rollers and control means for calculating the folding position based on a leading edge or a trailing edge of a sheet are also required in the conveyance path.

Letter Fold

A letter fold folds a sheet at two folding positions in the length of the sheet conveyance direction. In a letter fold, the leading edge side and the trailing edge side of the sheet are folded in the same direction.

As shown in FIG. 2(*a*), the sheet is first folded at a position located ⅓ of the length from the leading edge of a sheet in the sheet conveyance direction. Then, at the other end, the trailing edge of the sheet is folded over the leading edge at a position located ⅓ of the length from the trailing edge.

Therefore, a sheet that is folded in this manner is appropriately used as a letter to be inserted in an envelope. Thus, it is called a letter fold. Thus for this process, it is necessary to arrange in the conveyance path, a first roller, a folded sheet conveyance path for conveying a sheet folded by the folding roller, and a second folding roller in the folded sheet conveyance path.

Accordion Fold

An accordion fold folds a sheet at two folding positions in the length of the sheet conveyance direction. In an accordion fold, the leading edge side and the trailing edge side of the sheet are folded in opposite directions. As shown in FIG. 2(*b*), in an accordion fold, the sheet is first folded at a position located ⅓ of the length from the leading edge of the sheet in the sheet conveyance direction. Then, the trailing edge of the sheet is folded in an opposite direction at a position located ⅓ of the length from the trailing edge. A sheet that is folded in this manner is appropriately used as a direct mailing to be inserted in an envelope. Therefore, it is necessary to arrange a first folding roller at an upstream side and a second folding roller at the downstream side.

Double Parallel, or Gate, Fold

As illustrated in FIG. 2(*c*), in a double parallel, or gate, fold, the sheet is folded once at a position halfway in the center in the length of the sheet conveyance direction. Then, half of the sheet is folded again at the center in an opposite direction. Then, folded sheets are stacked sequentially and either bound by staples or have holes punched therein for filing as a series of documents. This makes it possible to bind a large-sized document, such as an A3-size document, as an A4-size document.

The following will explain the details of the paper folding unit having the structure illustrated in FIG. 3. The paper folding unit 200 comprises the sheet conveyance inlet 210 for taking in a sheet PA discharged from the image forming unit 100. The paper folding unit 200 also includes the pinch roller unit 230 comprising the sheet conveyance roller 211 for conveying the sheet PA taken in at the inlet, and a pair of pinch rollers 231 and 232. The input conveyance gate 240 is directly behind the pair of rollers at the sheet conveyance inlet. The input conveyance gate 240 switches the conveyance paths depending on whether there is a folding process to be applied to the sheet PA.

If there is no folding process to be applied to the sheet PA, the input conveyance gate 240 does not switch paths. Thus, the sheet PA is fed along the horizontal fourth conveyance path 253 formed of the pinch roller unit 230 and the sheet conveyance rollers opposed thereto, to the finishing unit 300. Note that the pinch roller unit 230 employs a hinging mechanism thereby allowing it to open and close. This makes it possible for an operator to easily handle paper feeding problems, such as a paper jam that may occur during the conveyance of a sheet.

Conversely, when a folding process has been selected by an operator, the input conveyance gate solenoid SL1 turns ON thereby causing the input conveyance gate 240 to switch the conveyance path. When the path is switched, the sheet PA is conveyed into the sheet conveyance path 250 (hereinafter referred to as a first conveyance path) for folding. There is an inlet sensor SS1 for detecting the input conveyance of the sheet PA on the first conveyance path 250, after the sheet PA has passed the input conveyance gate 240. The folding drive motor M2 begins to drive to fold the sheets when the inlet sensor SS1 has detected the sheet PA.

There are an input conveyance roller 212 and a pinch roller 233 disposed at a downstream side of the inlet sensor SS1. The input conveyance roller 212 and the pinch roller 233 are the first conveyance means for feeding the sheet PA into the folding unit. A path sensor SS2 for detecting the sheet PA and for detecting any conveyance jam of the sheet PA is disposed in front of input conveyance roller 212 and pinch roller 233. A sheet trailing edge stopper 242 (i.e., a regulating means), described below, is disposed at a downstream side of input conveyance roller 212 and pinch roller 233.

A first roller 214, a second roller 215, and a third roller 216 are arranged at a downstream side of the first conveyance path 250. The first roller 214 and the second roller 215, and the second roller 215 and the third roller 216 are in contact. A space is formed by the touching rollers and the conveyance path. The first conveyance path 250 and the first roller 214, and the space of the contact with the second roller 215 form a folding 1 loop forming portion 255. Paper can be charged with static electricity at the main unit, which can affect the folding of the paper. So, a discharging brush 260 is arranged in this portion that is substantially equivalent to the top portion of the paper folding portion for removing static electricity from the surface of the sheet.

A folded sheet conveyance path 251 (hereinafter referred to as a second conveyance path) at a downstream side of the conveyance path, on the opposite side of the contact of the first roller 214 and the second roller 215, and the contact of the second roller and the third roller 216, forms a folding 2 loop forming portion 256. A pair of rollers (a second conveyance means) comprising the registration SB roller 213 and the pinch roller SB 234 are disposed at a downstream side of the folding 1 loop forming portion 255 on the first conveyance path 250. Directly in front of registration SB roller 213 and pinch roller SB 234 is the pre-registration sensor SS3. The post registration sensor SS4 is disposed directly after registration SB roller 213 and pinch roller SB 234. This pair of registration rollers (i.e., registration SB roller 213 and pinch roller SB 234) registers the sheet PA and removes any skewing of the conveyed sheet PA. There is also a folding 1 sheet backside path 254 still farther downstream. The folding 1 sheet backside path 254 is a conveyance path for storing a sheet when handling a sheet that is long in the conveyance direction.

The second conveyance path 251 comprises a curved guide member, as shown in FIG. 3. The second conveyance path 251 is formed by a plate shaped member curved in a direction overlapping a folded sheet. The sheet PA is conveyed in a folded state in the second conveyance path 251 by the nipping contact of the first roller 214 and the second roller 215. A folding reference stopper 243 (i.e., a stopper member comprising a lever member, described below) capable of changing positions, is arranged near a most downstream portion of the second conveyance path 251. The lever member has a rotating pivot point at a center of the curvature of the curved guide member, thus making it possible to be rotated to any predetermined angle by the stopper moving motor M4.

That is, the position of the folding reference stopper 243 is adjusted at the second conveyance path by the stopper moving motor M4. A sheet pressing guide 244, described below, is disposed on the second conveyance path 251 near the folding 2 loop forming portion 256. The sheet pressing guide 244 rotates to prevent creasing of the corners of a sheet caused by the sheet flapping during the folding process. A sheet detection sensor SS5 is disposed at a downstream side of the sheet pressing guide 244 for monitoring the path for any possible paper jams when paper is being folded.

Next, a second paper folding is performed by conveying the sheet PA by nipping it between the contact of the second roller 215 and the third roller 216. Thereafter, a pair of rollers comprising a conveyance roller 217 and a discharge pinch roller 235 applies pressure at the folded portion while conveying the sheet PA to ensure a satisfactory fold.

After the folding process is completed, the sheet PA is conveyed through a sheet discharge path 252 (hereinafter referred to as a third conveyance path) to the finishing unit 300. The sheet PA is conveyed by each of the pairs of conveyance rollers 218, 219, 220, 221, 222, and the associated conveyance pinch rollers 236, and then by the pair of the roller 223 and the conveyance pinch roller 236.

A storage gate 241 is disposed directly after the conveyance roller 218 on the third conveyance path 252. Storage gate 241 guides sheets that have been letter folded or accordion folded for storage in a folded sheet storage box 280 disposed below gate 241. A folding unit discharge sensor SS6 is disposed near the storage gate 241. Discharge sensor SS6 checks to ensure that a sheet is conveyed past the storage gate 241, and is stored in the folded sheet storage box 280.

A full detection sensor SS7 is disposed above the folded sheet storage box 280. The sensor SS7 uses a folded sheet pressing flapper 282 to detect that the storage box 280 is full. The folded sheet storage box 280 is detachable along a guide rail disposed on the paper folding unit side. A stand-shaped protrusion is disposed on an end of one side of a rack that rotates a folded sheet processing flapper 282. Therefore, when detaching, the folded sheet storage box 280 of the paper folding unit engages the stand-shaped protrusion at the edge of the detachment opening, thereby enabling the folded sheet pressing flapper 282 to rotate and retract into the folded sheet storage box 280.

A sheet that has been folded in ways other than the letter fold or the accordion fold passes the storage gate 241 and is conveyed by the conveyance roller and the pinch roller pairs to merge into the horizontal fourth conveyance path 253 formed by the pinch roller unit 230 and the sheet conveyance rollers 211 opposed thereto, and then fed into the sheet finishing unit 300. A sheet discharge sensor SS8 is disposed immediately after the emerging point of the fourth conveyance path 253 for monitoring the conveyance of the folded sheet. The folding unit control unit 290 sends a paper detection signal (from the sheet discharge sensor SS8) to the finishing unit 300.

An upper drawer rail 201 and a lower drawer rail 202 are disposed, respectively, at the appropriate positions inside the top and bottom of the paper folding unit to enable the paper folding unit, including the paper conveyance paths, to be pulled out for maintenance. The paper folding unit control unit 290, including the power source for drive of the paper folding unit 200, is embedded at the bottommost portion inside the paper folding unit 200. Casters are mounted at the bottom of the paper folding unit frame to support the heavy device, and to enable it to be moved.

Description of a Stopper Mechanism

Registration SB Rollers

The registration SB roller 213 (i.e., a leading edge aligning means) is independently driven by a registration motor M3 comprising a pulse motor, and is driven separately from the other conveyance rollers. The pinch roller 234 is in pressing contact with the registration SB roller 213 to nip and convey a sheet. However, the pinch roller 234 can be stopped at any time by the registration motor M3. When a sheet is conveyed by the input conveyance roller 212, the registration SB roller 213 is in a stopped state. So, the leading edge of a sheet is stopped at a position corresponding to the nipping contact line of the registration SB roller 213 and the pinch roller 234. Thus, the registration SB roller 213 functions as a paper stopper. If the registration motor M3 is stopped during the nipping conveyance of a sheet by the roller pairs of the registration SB roller 213 and the pinch roller 234, the conveyance of the sheet is stopped, as above, at the nipping point, and again, the registration SB roller 213 functions as a paper stopper. Energizing the registration motor M3 (a pulse motor) makes it possible to securely stop the sheet.

Sheet Trailing Edge Stopper

Figure 8A:
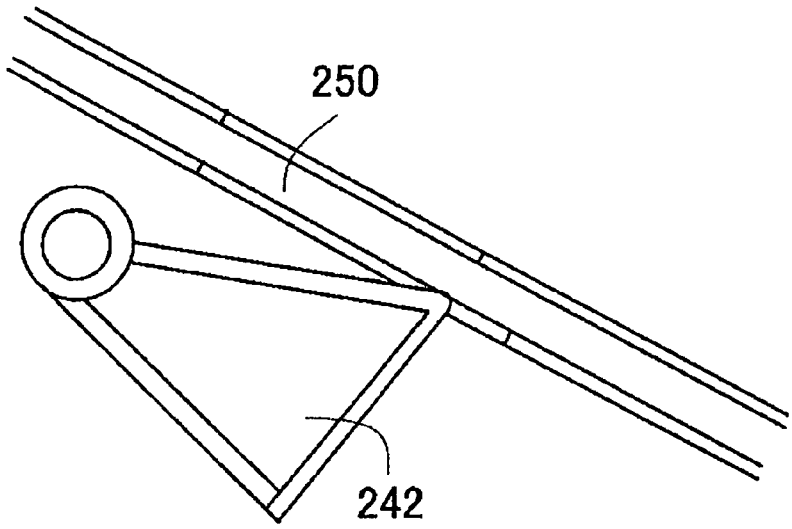
FIG. 8(*a*) is a sectional view of a sheet trailing edge stopper in which a stopper is positioned outside of a conveyance path.
Figure 8B:
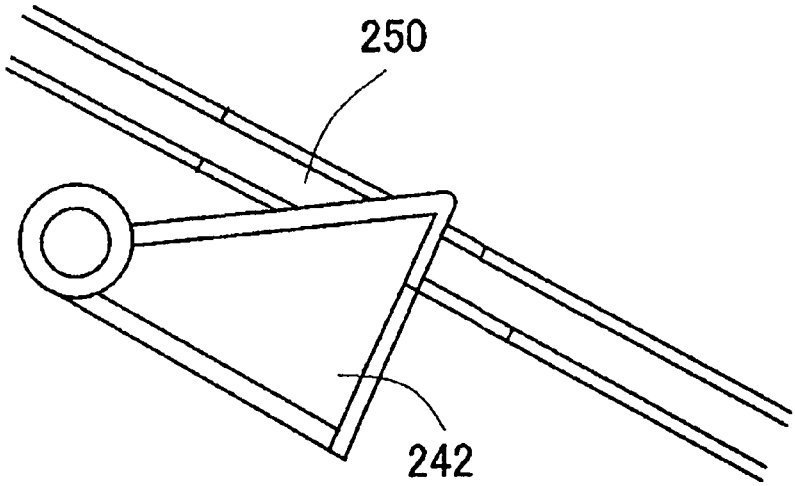

The following describes the sheet trailing edge stopper with reference to FIGS. 8(*a*) and 8(*b*).

FIG. 8(*b*) is a partially sectional view of the sheet trailing edge stopper 242 disposed in the first conveyance path 250. The sheet trailing edge stopper 242 is a triangular lever that swings around a rotating point at an upstream side outside of the conveyance path 250. The sheet trailing edge stopper 242 is arranged to advance into the conveyance path through notches formed in portions of the conveyance path surfaces. A dead weight moment acts on the sheet trailing edge stopper 242 by the center of gravity position so as to be constantly positioned in the conveyance path.

The sheet trailing edge stopper 242 is positioned at a downstream side of the input conveyance roller 212, so that when a sheet is fed by the input conveyance roller 212, the leading edge of the sheet travels along the oblique surface of the lever of the sheet trailing edge stopper 242. Then, while advancing, the sheet pushes the lever to the outside of the conveyance path. The sheet trailing edge stopper 242 returns back into the conveyance path by a deadweight moment after the trailing edge of the sheet passes thereover. At this time, as is shown in FIG. 8(*b*), a side of the triangular shaped sheet trailing edge stopper 242 is positioned to intersect the conveyance direction of the conveyance path.

Figure 9:
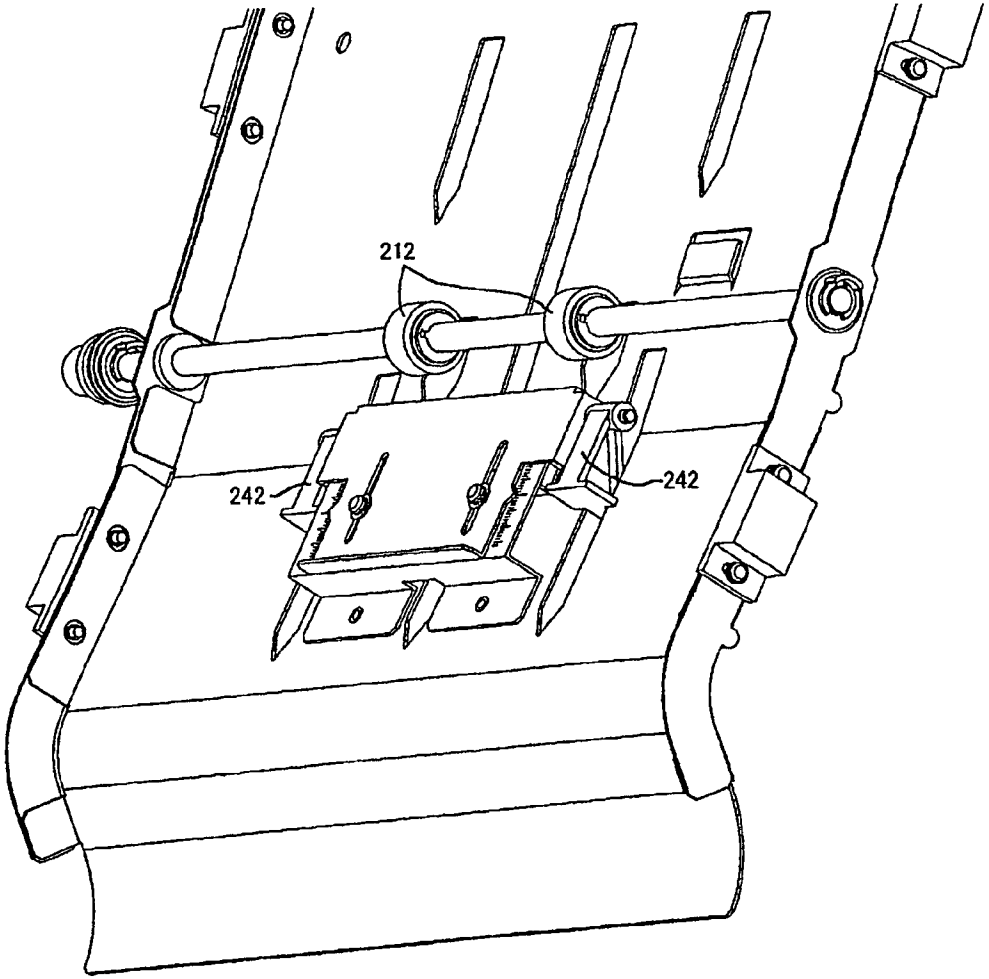
FIG. 9 is a perspective view illustrating the relationship between the sheet trailing edge stopper and input conveyance rollers.

Therefore, after the trailing edge of the sheet passes over the sheet trailing edge stopper 242, and the registration SB roller 213 reversingly rotates to convey the sheet in a direction opposite to the conveyance direction, the sheet trailing edge stopper 242 will function as a paper stopper. The sheet trailing edge stopper 242 is unitized (see FIG. 9). Screws that can vary position in the path guide adjust the position of the fastened stopper.

Folding Reference Stopper

Figure 10:
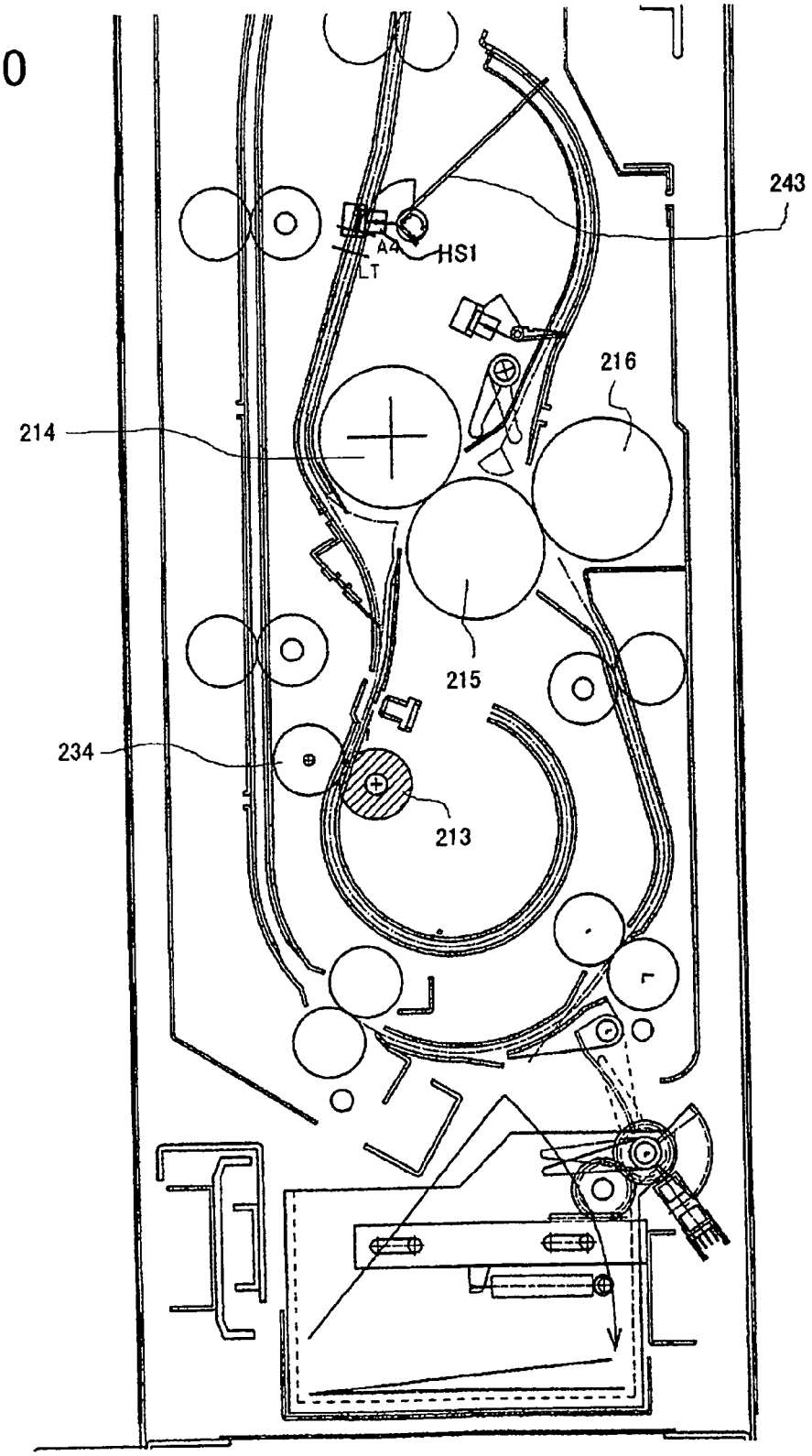
FIG. 10 is a structural view of a folding reference stopper.

The following describes the function and structure of the folding stopper with reference to FIG. 10.

The first folding process is performed by the first roller 214 and the second roller 215. For a second folding process, the top of the folded portion is nippingly conveyed to the second conveyance path 251. The folding reference stopper 243, movably disposed at a downstream side of the second conveyance path 251, engages the folded portion to check the conveyance of the sheet. This forms a loop in the folding 2 loop forming unit 256, and urges the second folding process at the second roller 215 and the third roller 216. The folding reference stopper 243 functions to establish a second folding position by varying the stopper position. This enables the use of different folding modes, such as the letter folding process, the accordion folding process, and the double parallel, or gate, folding process.

As shown in FIG. 10, the folding reference stopper 243 is driven directly by the stopper drive motor M4, which comprises a pulse motor. A folding reference home detection sensor HS1 for detecting the rotation of a mask plate coaxially mounted to the motor shaft determines the initial position of the stopper 243. The sensor HS1 controls the amount of movement from the initial position by counting motor pulses.

Sheet Pressing Guide

Figure 7B:
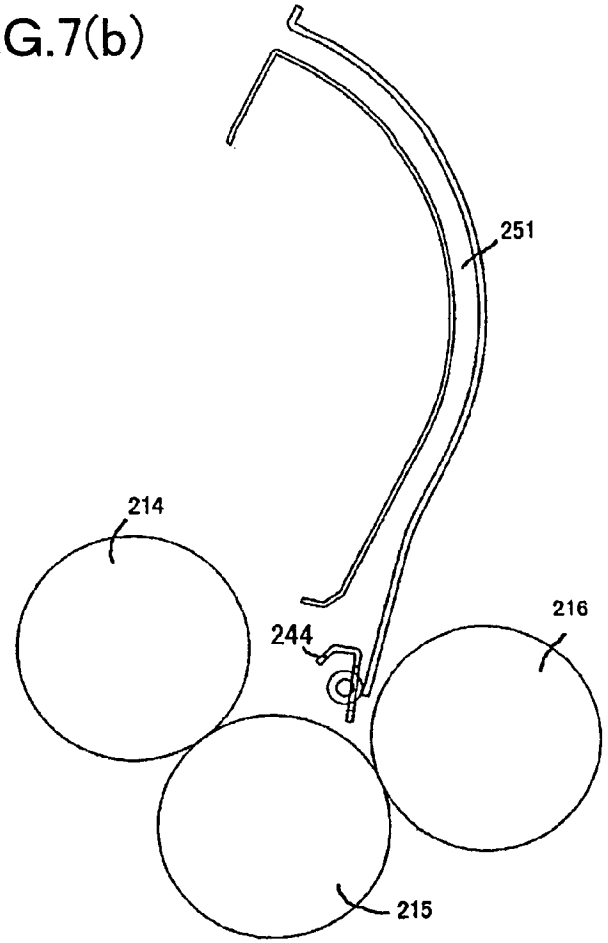
FIG. 7(*a*) is a sectional view of the sheet pressing guide, and illustrates the insertion of the sheet.
Figure 7A:
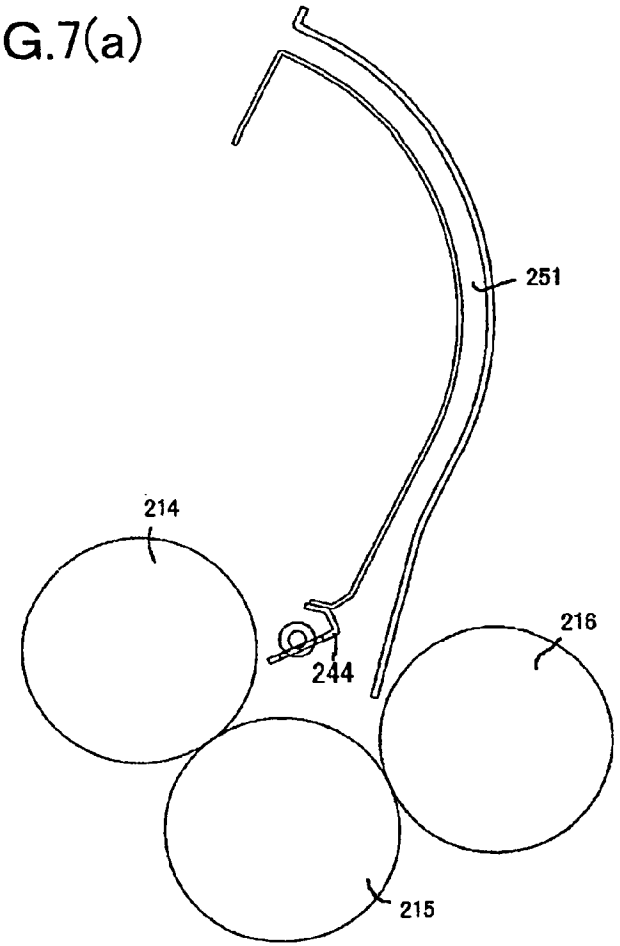

The following describes the sheet pressing guide with reference to FIGS. 7(*a*) and 7(*b*).

FIG. 7(*a*) illustrates an inlet portion of a conveyance path of the folding roller side. The drawing is a sectional view of the second conveyance path 251. The sheet pressing guide 244 is rotatingly supported on a support shaft fastened to a side of the second conveyance path guide 251. This is illustrated in FIG. 7(*b*). The sheet pressing guide 244 rotates when the pressing solenoid SL4 is ON so as to press the paper. When the solenoid SL4 is turned OFF, the force of a spring returns the sheet pressing guide 244 to its original position. The sheet pressing guide 244 has a plurality of pressing rollers that rotate in the sheet conveyance direction to reduce the conveyance resistance to a minimum when pressing the sheet.

As shown in FIG. 7(*a*), normally the sheet pressing guide 244 is positioned to guide a sheet that has undergone the first folding process to a second conveyance path 251. The sheet pressing guide 244 presses a sheet by reversing from the first roller 214 side to the third roller 216 side, thereby preventing the corners of the sheet from being caught and creased or wrinkled if the edge of the sheet floats up during the second folding process. The pressing solenoid SL4 activates after a predetermined amount of time (set for each of the folding modes) has passed from the point that the folded sheet detection sensor SS5 detects the folded portion of the sheet. The aforementioned describes the timing used for the reversing action of the sheet pressing guide 244.

Conveyance Drive System

Figure 4:
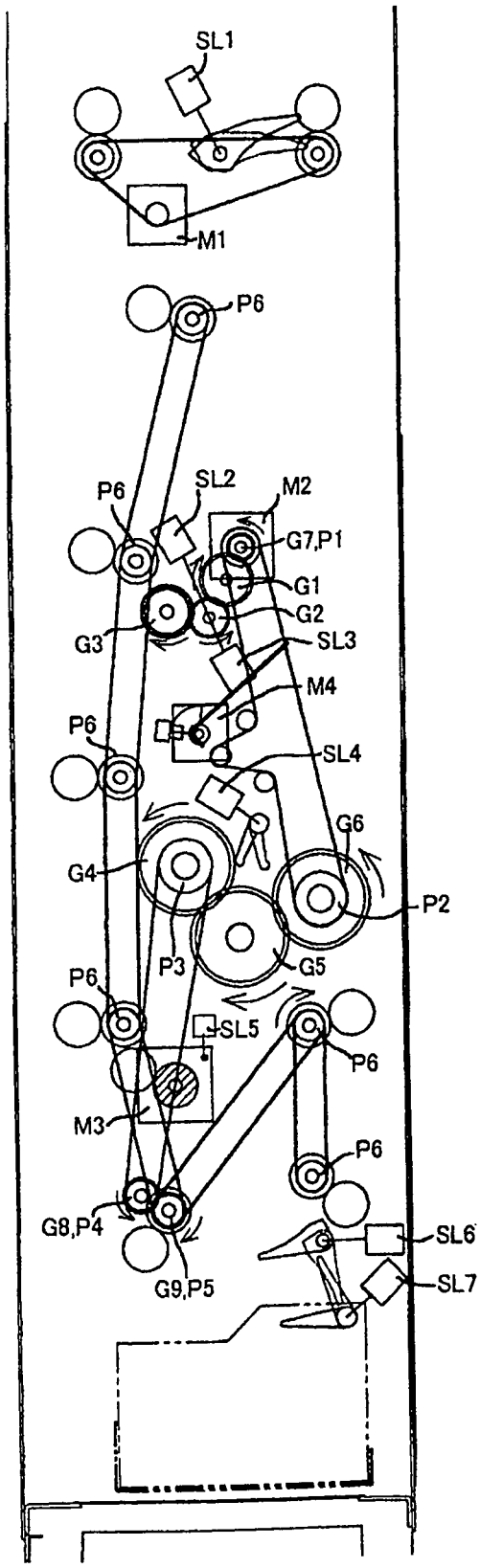
FIG. 4 is a view of the conveyance drive system of the paper folding unit.

The following describes the conveyance drive system of the paper folding unit 200 with reference to FIG. 4.

Upper Conveyance Drive System

The fourth conveyance path 253 (i.e., the upper conveyance system) operates independently to bypass the folding process conveyance system of the paper folding unit 200 when no folding procedure has been specified. In the front and back sides of the conveyance path there are sheet conveyance rollers 211. The sheet conveyance rollers 211 are driven by an independent conveyance motor M1 via a timing belt. However, if a sheet is folded and is to receive a further finishing process, the folded sheet merges into the fourth conveyance path 253, and feeds into the finishing unit 300 after a folding process.

Folding Unit Conveyance Drive System

Drive from the folding drive motor M2 (a brushless motor) is provided for the folding unit conveyance drive system, except for the drive of the registration SB roller 213. The drive transmission system transmits drive from a pulley P1 unitized to a gear G7 on motor M2 mounted to a folding drive motor shaft to a third pulley P2 unitized to a third roller gear G6 via the timing belt. Drive is further transmitted by the third roller gear G6, a second roller gear G5 and a first roller gear G4. The gear G7 of motor M2 fastened to the folding drive motor shaft drives the conveyance roller 212 via the first gear G1, the second gear G2, and the third gear G3.

Drive is transmitted from the first pulley P3 unitized to the first roller gear G4 via a timing belt to a first transmission gear pulley P4 unitized to a first transmission gear G8. When rotated in an opposite direction, drive is transmitted from the first transmission gear G8 to a second transmission gear G9, so that the second transmission gear G9 drives the conveyance roller 219 coaxially mounted to the same shaft. Conveyance roller pulleys P6 are mounted to the same shafts as the conveyance rollers 218, 219, 220, 221, 222, and 223. Drive from the conveyance roller pulleys P6 mounted to the same shafts as the conveyance roller 219 is sequentially transmitted to the conveyance rollers 220, 221, 222, and 223 of the third conveyance path 252 by a belt. Drive is then branched from the conveyance roller pulleys P6 mounted to the same shaft as the conveyance roller 219, and sequentially transmitted to the conveyance roller 217 and the conveyance roller 218 by another belt.

Registration SB Roller Drive System

Figure 11A:
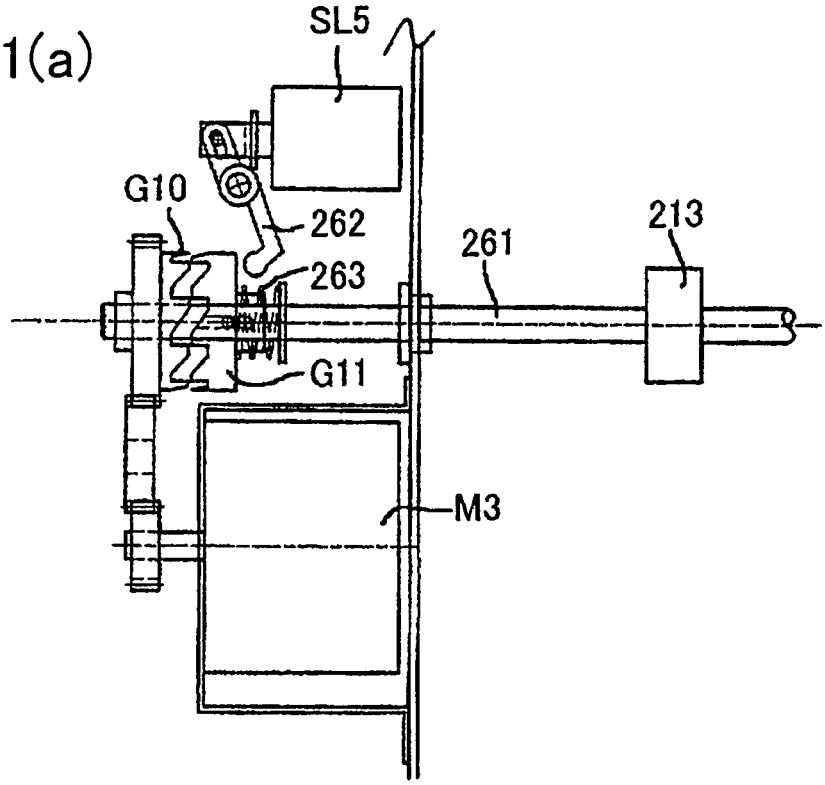
FIG. 11(*a*) is view of a registration SB (switch back) roller drive transmission system mechanism in which the solenoid is OFF and the clutch is disengaged.
Figure 11B:
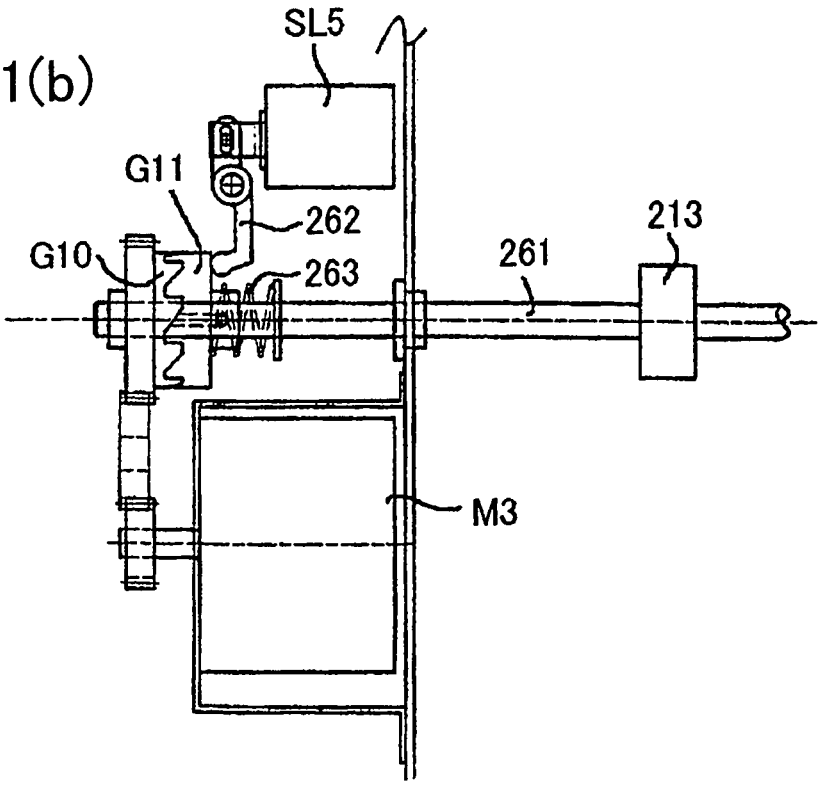

The following describes the registration SB roller drive mechanism with reference to FIGS. 11(*a*) and 11(*b*).

The registration SB roller 213 is independently driven by the registration motor M3 for correcting any skewing of the conveyed sheet, and for folding a sheet. The registration SB roller 213 is driven independently of the other conveyance rollers.

A jagged-toothed clutch mechanism is employed in the drive transmission from the registration motor M3 to the registration SB roller 213. The clutch mechanism is illustrated in FIG. 11(*a*). A unitized gear ratchet G10 on one side of the jagged-tooth clutch is matingly positioned to rotate on the registration SB roller shaft 261 unitized to a transmission gear directly linked to the registration motor M3. The shaft fastened to ratchet G11 on the other side of the jagged-tooth clutch rotates as one body with the registration SB roller shaft 261 via a parallel pin. A long hole is disposed in the shaft to which the parallel pin engages the shaft fastened to ratchet G11, thereby enabling the minimum necessary movement in the shaft direction even when disengaged. Because the ratchet clutch is jagged, it is possible to transmit drive in a single direction when the registration motor M3 is driven with either a forward direction or a reverse direction force. However, the shaft direction force functions to disengage the clutch when rotated in the opposite direction.

A pressing spring 263 is inserted to urge the ratchet G11 toward the registration SB roller shaft 261 in a direction to engage the shaft fastened ratchet G10. A ratchet solenoid SL5 turns the pressing function ON and OFF in a direction so as to engage the back surface of the shaft fastened ratchet G11 via the ratchet pressing lever 262. When conveying a sheet primarily with the registration SB roller 213, the ratchet solenoid SL5 is turned ON to ensure the meshing of the back surface of the shaft fastened ratchet G11 by the ratchet pressing lever 262.

The following functions are required of the registration SB roller 213: (1) to be a roller for engaging a leading end of a sheet to remove any skewing of the sheet; (2) to convey a sheet in both forward and reverse directions when applying a letter folder process; (3) to hold a positioned sheet that is nippingly conveyed when applying an accordion folding process; and (4) to completely follow the folding rollers (i.e., first roller 214, second roller 215, and third roller 216) when conveying the sheet into the nip therebetween (i.e., so there is no load applied to the folding rollers 214, 215, and 216).

The configuration described above is employed in particular because of the fourth function. In other words, when a folding process is applied to a sheet while it is nipped by the registration SB roller 213, the folding rollers (i.e., first roller 214, second roller 215, and third roller 216) are mainly applied to a sheet that is being transferred to enable the folding function to be performed correctly. Thus, it is necessary to allow the registration SB roller 213 to follow the folding rollers 214, 215, and 216 until the sheet is completely conveyed by the folding rollers.

As shown in FIGS. 11(*a*) and 11(*b*), a jagged-shaped clutch mechanism is employed. When nippingly conveying a sheet by the folding rollers 214, 215, and 216 while the sheet is nipped by the registration SB roller 213, the ratchet solenoid SL5 is turned OFF. This disengages the clutch with the conveyance force of the folding rollers 214, 215, and 216 allowing the registration SB roller 213 to rotate freely. To satisfy function (4) of the registration SB roller 213, it is also perfectly acceptable to release the pressing of the pinch roller 234, which is the companion to the registration SB roller 213, rather than to use a clutch. Nevertheless, as long as dependability is maintained at the time of release, either of the aforementioned methods is acceptable.

Input Conveyance Roller Configuration

Figure 5:
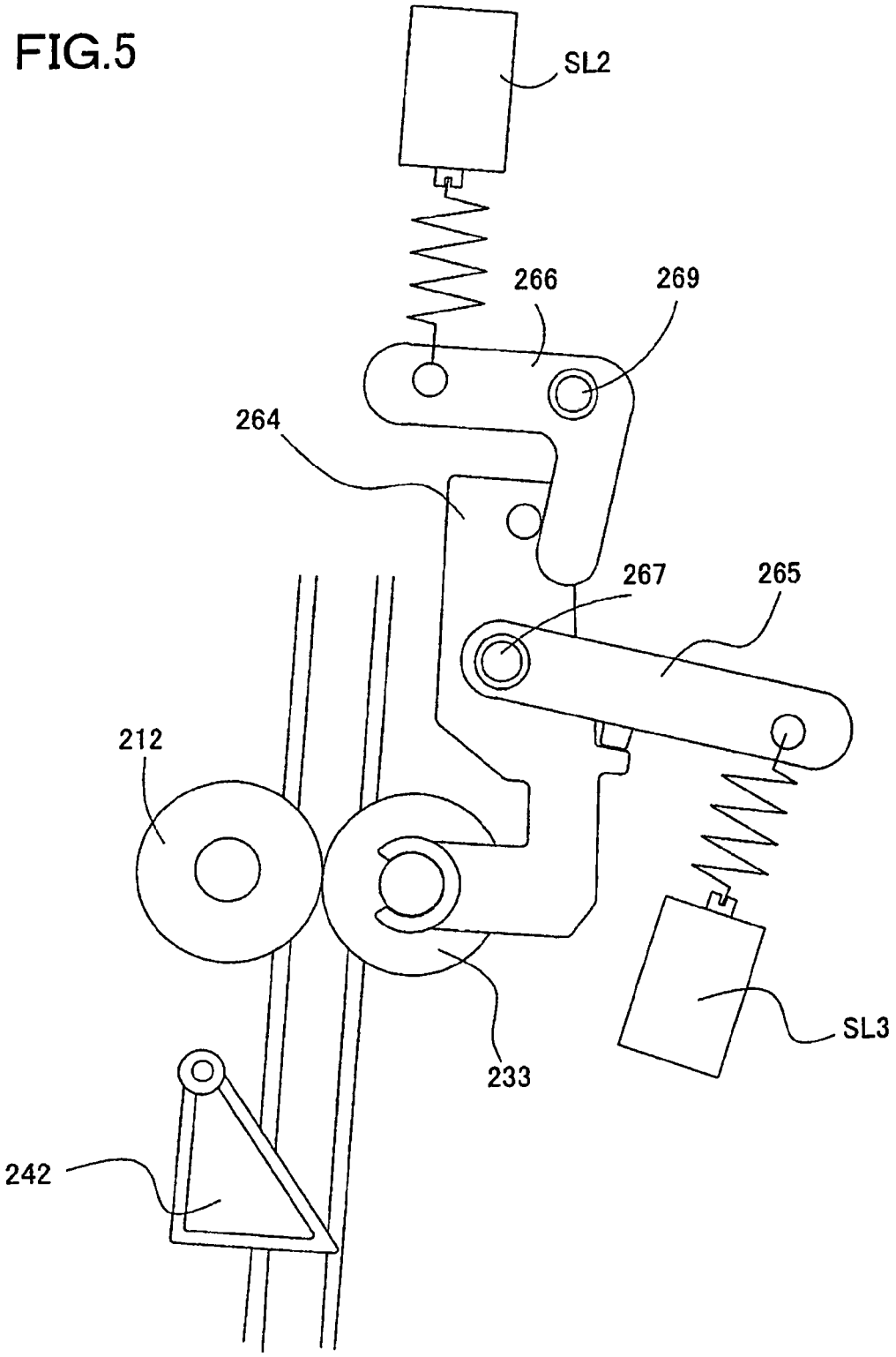
FIG. 5 is a structural view of an input conveyance roller and pinch roller pressing and releasing mechanism.
Figure 6A:
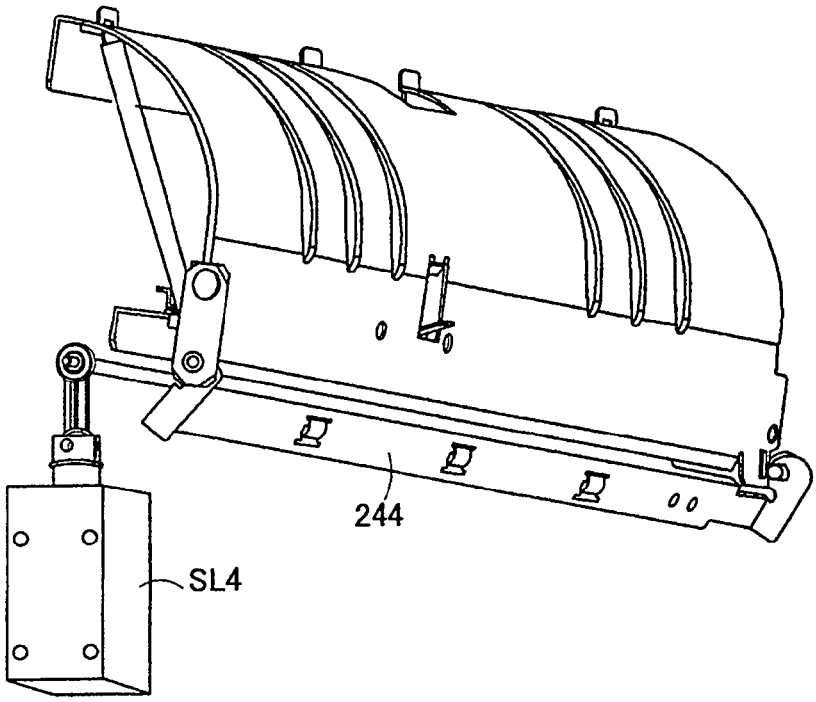
Figure 6B:
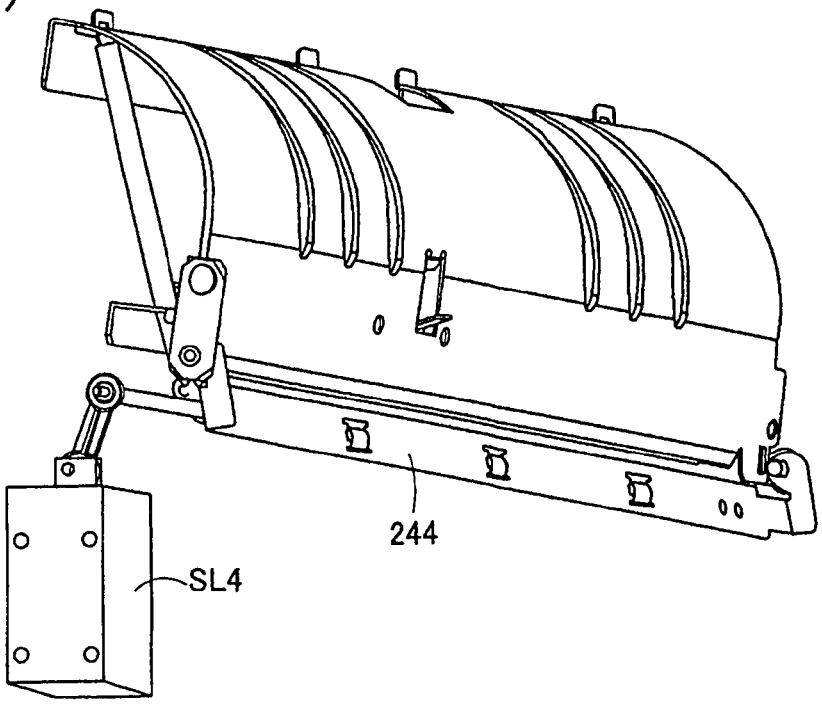

The mechanism illustrated in FIG. 5 is employed for the touching and separation of the conveyance rollers. The input conveyance roller 212 and the pinch roller 233 are a pair. The pinch roller 233 is rotatingly supported on a pinch lever 264 matingly supported to enable it to swing on the pinch shaft 267 fastened to a device frame (frame not shown). An urging spring presses the pinch roller 233 against its companion, the input conveyance roller 212. A pressure arm 265 pivotally supported by a shaft 267 engages a pinch lever 264. The pressure arm 265 acts to press the pinch roller 233 into contact with the input conveyance roller 212 by action of the pressure solenoid SL3. Particularly, when registering the leading edge of a sheet, the pressure solenoid is turned on, causing the pressure arm 265 matingly supported to enable it to swing on the pinch shaft 267 to press the pinch roller 233 into contact with the input conveyance roller 212. This increases conveyance force, and enables a loop to be formed in the sheet for the purpose of registration.

It is necessary to separate the pinch roller 233 from the input conveyance roller 212 in order to free the sheet after registration and removing any skew in the sheet, or when handing over the sheet from the input conveyance roller 212 to the folding rollers. To achieve the separation, the separating solenoid SL2 is turned on. Turning on solenoid SL2 enables a separating arm 266 matingly supported to rotate about a separation arm shaft 269 fastened to a conveyance frame (frame not shown). Rotation of the separation arm shaft 269 rotates the pinch lever 264 in a direction so that the pinch roller 233 separates from the input conveyance roller 212.

The separating arm 266 and the separating solenoid SL2 mounted thereto are disposed in a direction (i.e., the counterclockwise direction in FIG. 5) for separating the pinch roller 233 from the input conveyance roller 212 around the center shaft 267 of the pinch lever 264. Therefore, the pinch roller 233 is pressed against the input conveyance roller 212 by the urging spring. When the pressure solenoid SL3 is energized, the pinch roller 233 presses firmly against a sheet and input conveyance roller 212 so as to securely convey a sheet. When the separating solenoid SL2 is not energized, the pinch roller 233 separates from the input conveyance roller 212, thereby enabling the sheet to be uncontrolled by the rollers.

By virtue of the aforementioned configuration, the separating solenoid SL2 and the pressure solenoid SL3 press the pinch roller 233 into contact and out of contact with the input conveyance roller 212. That is, SL3 firmly presses the pinch roller 233 against the input conveyance roller so as to firmly convey a sheet. When the input conveyance roller 212 and the pinch roller 233 are separated by the separating solenoid SL2, the rollers separate in resistance to the urging spring, which has comparatively weak urging force. Therefore, the separating solenoid SL2 can be a compact device.

Folded Sheet Storage Box Full Detection Mechanism

Figure 12:
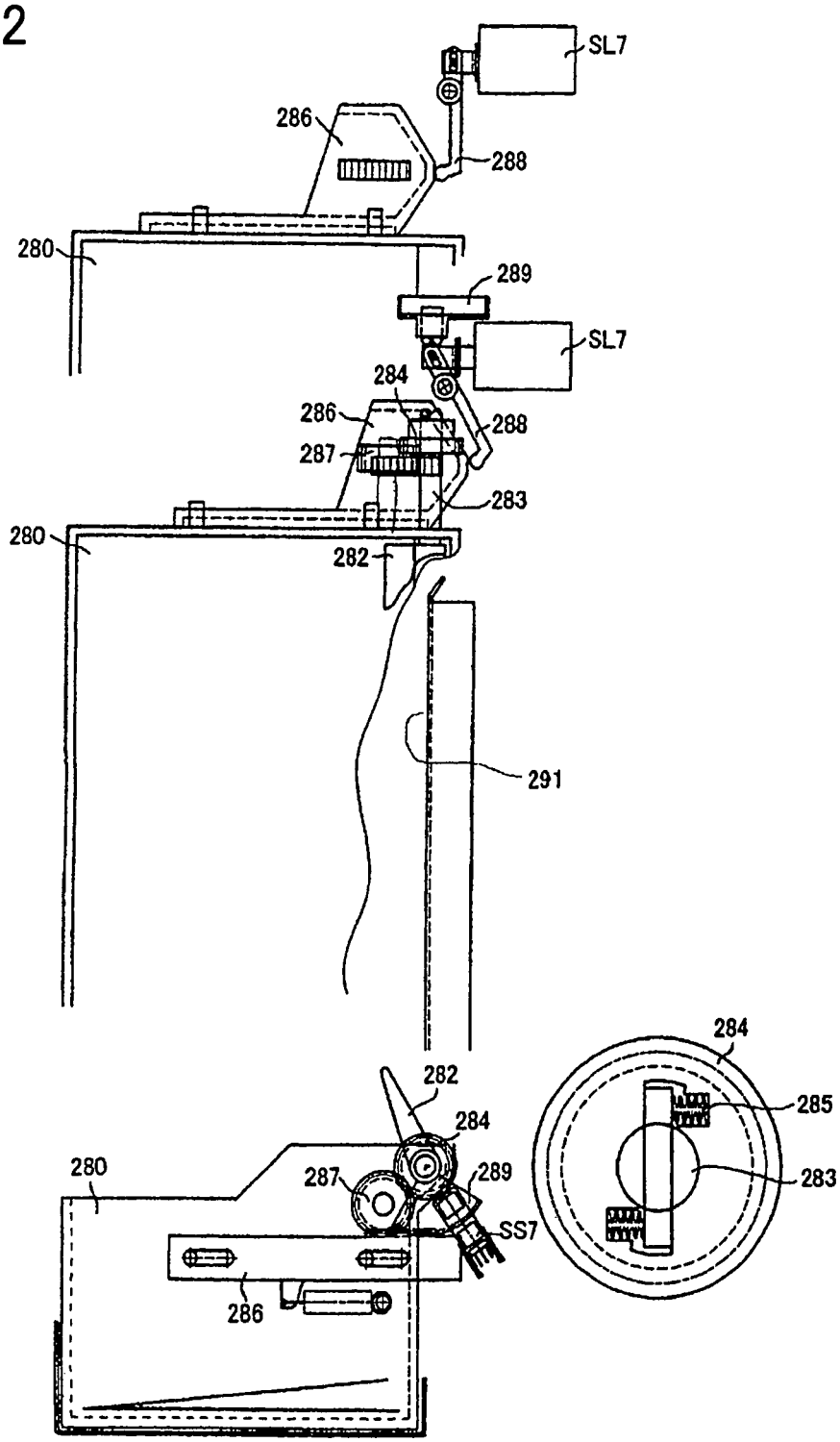
FIG. 12 illustrates a full detection mechanism of the folded sheet storage box.
Figure 13A:
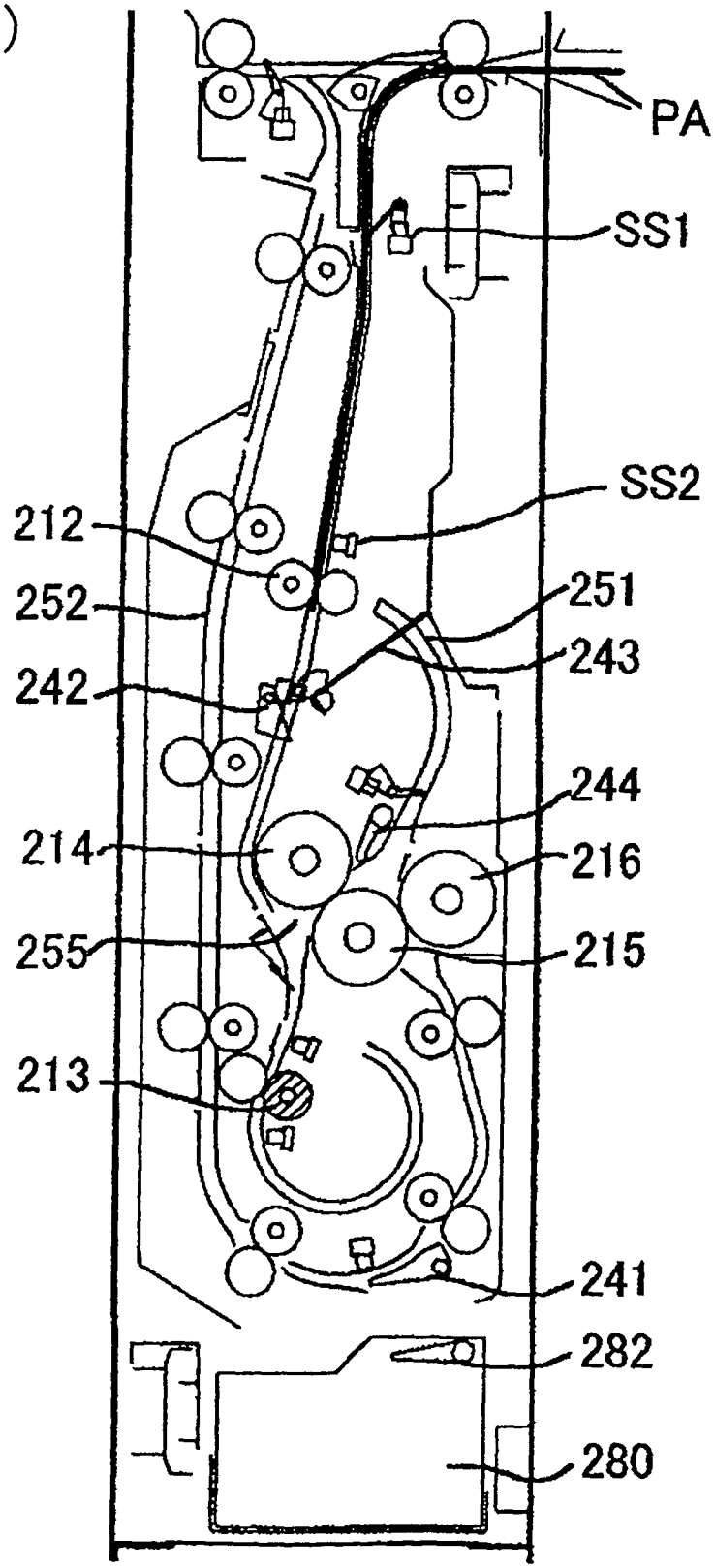
FIG. 13(*a*) is a view of the flow of operations for a letter fold, and illustrates a first step in a first folding format.
Figure 13B:
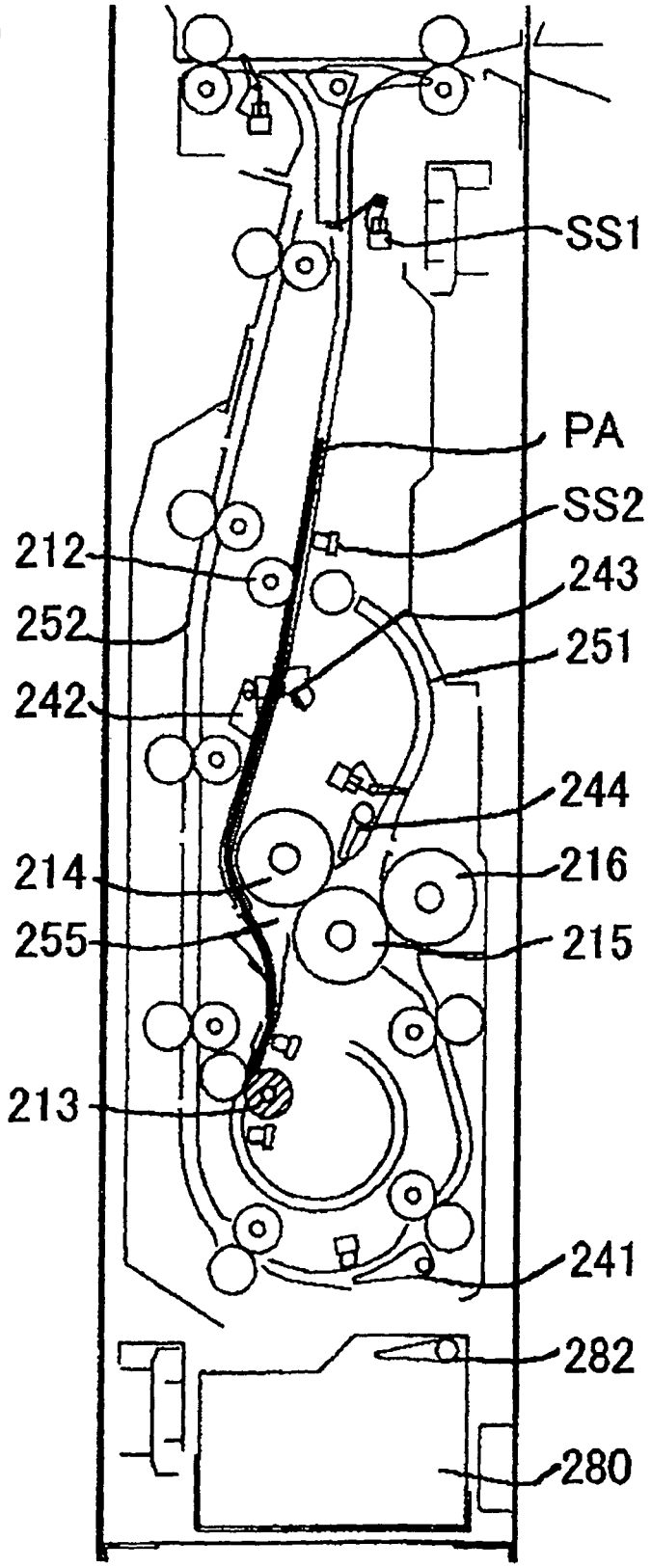
Figure 13C:
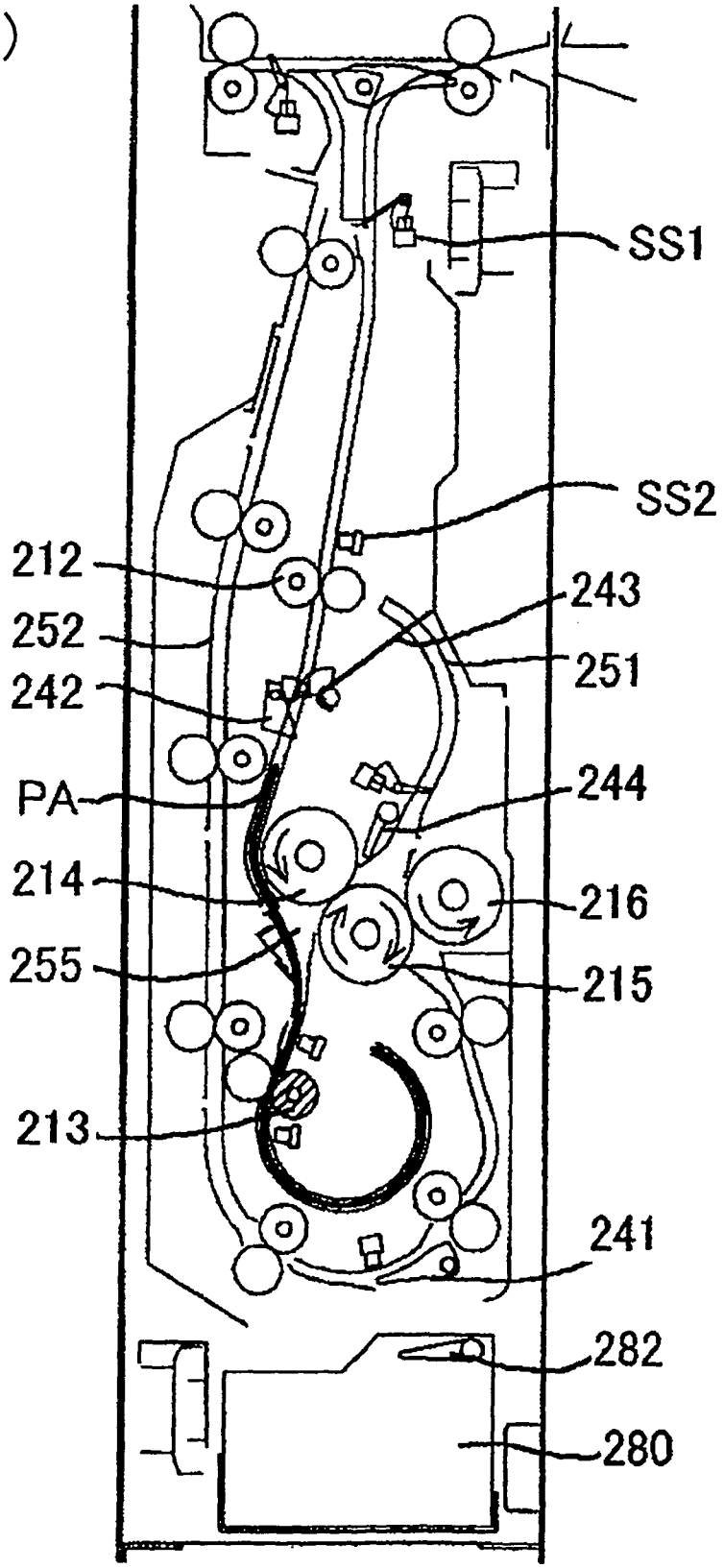
Figure 13D:
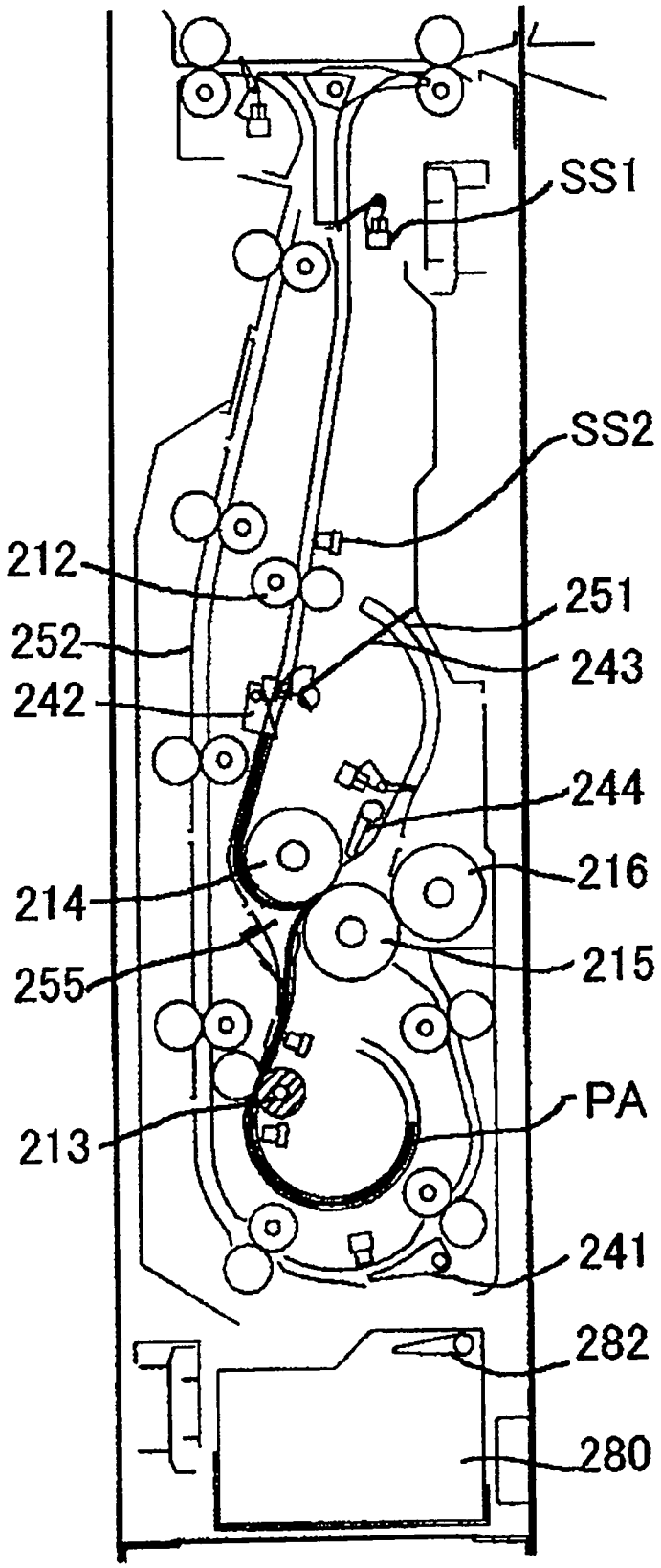
Figure 13E:
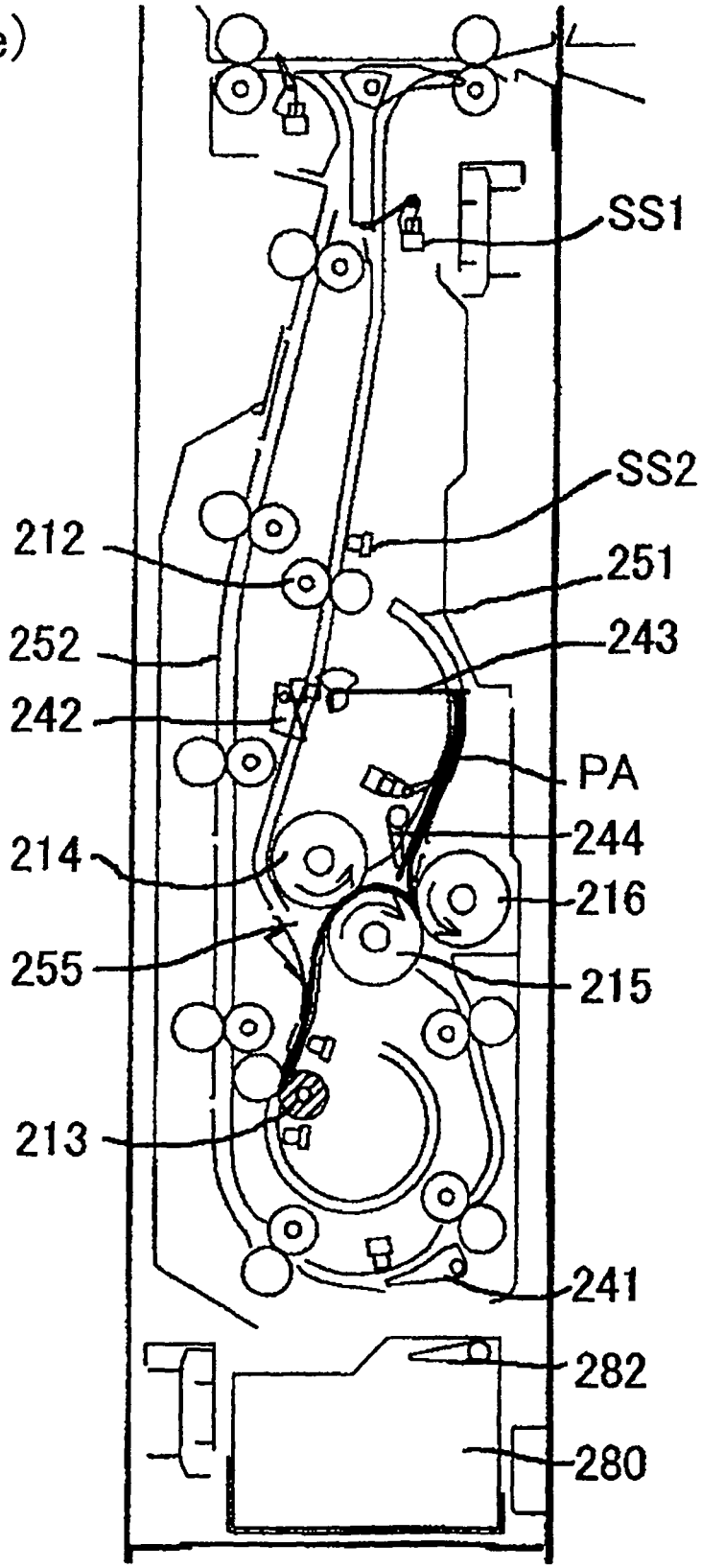
Figure 13F:
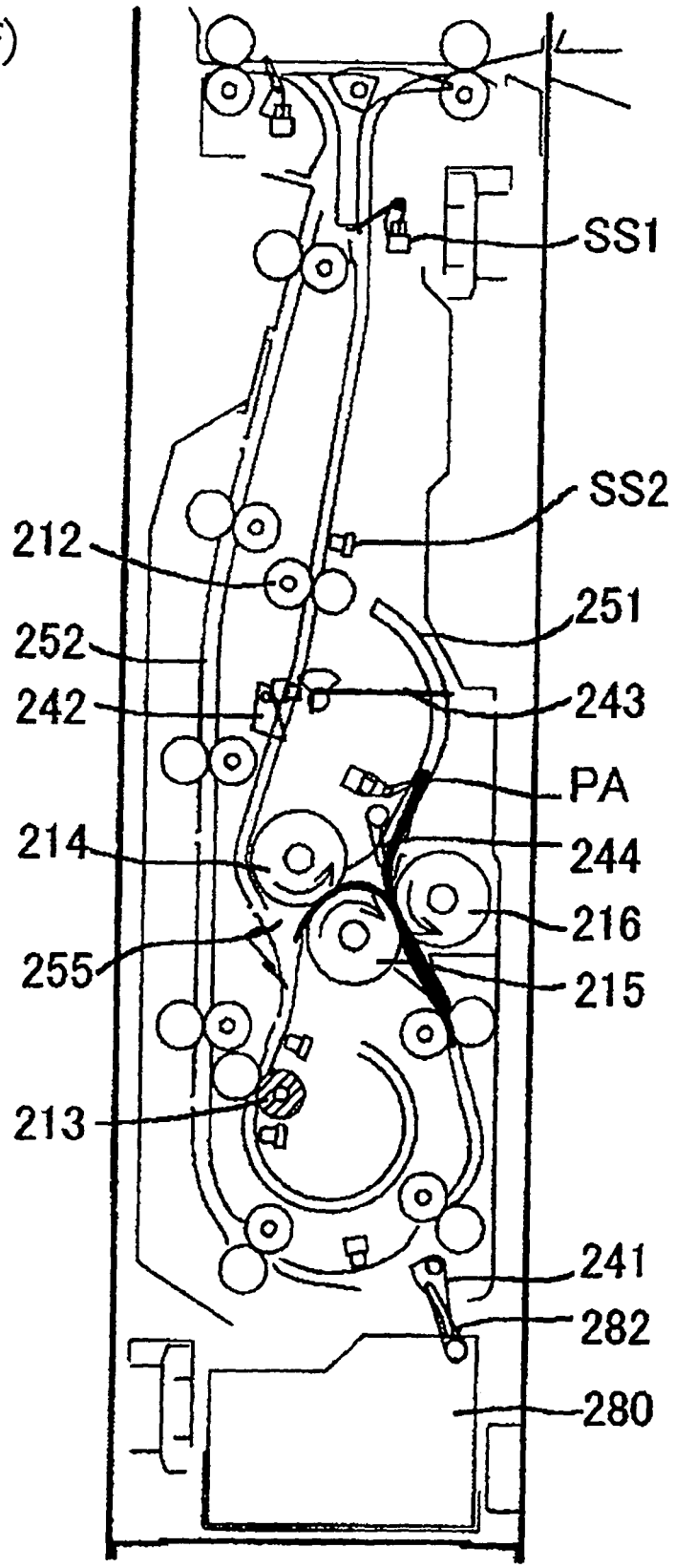
Figure 13G:
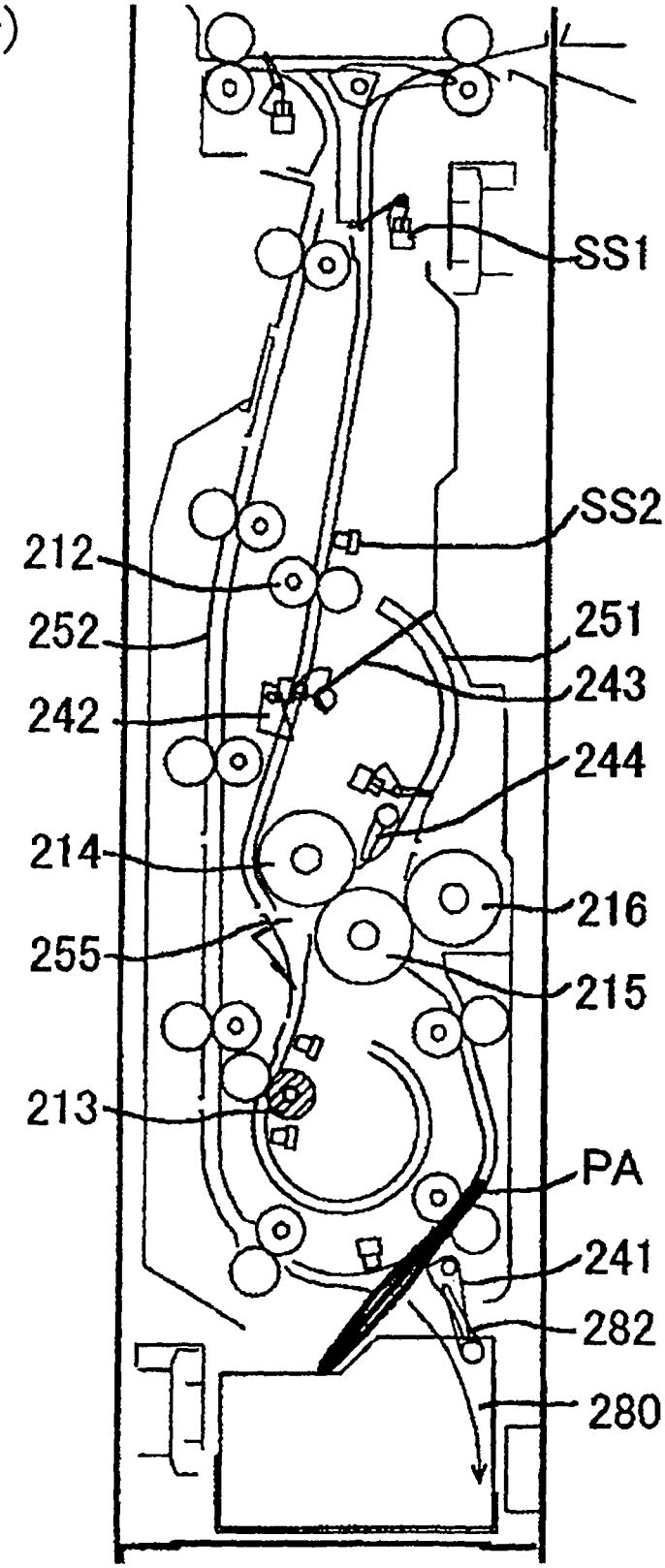
Figure 13H:
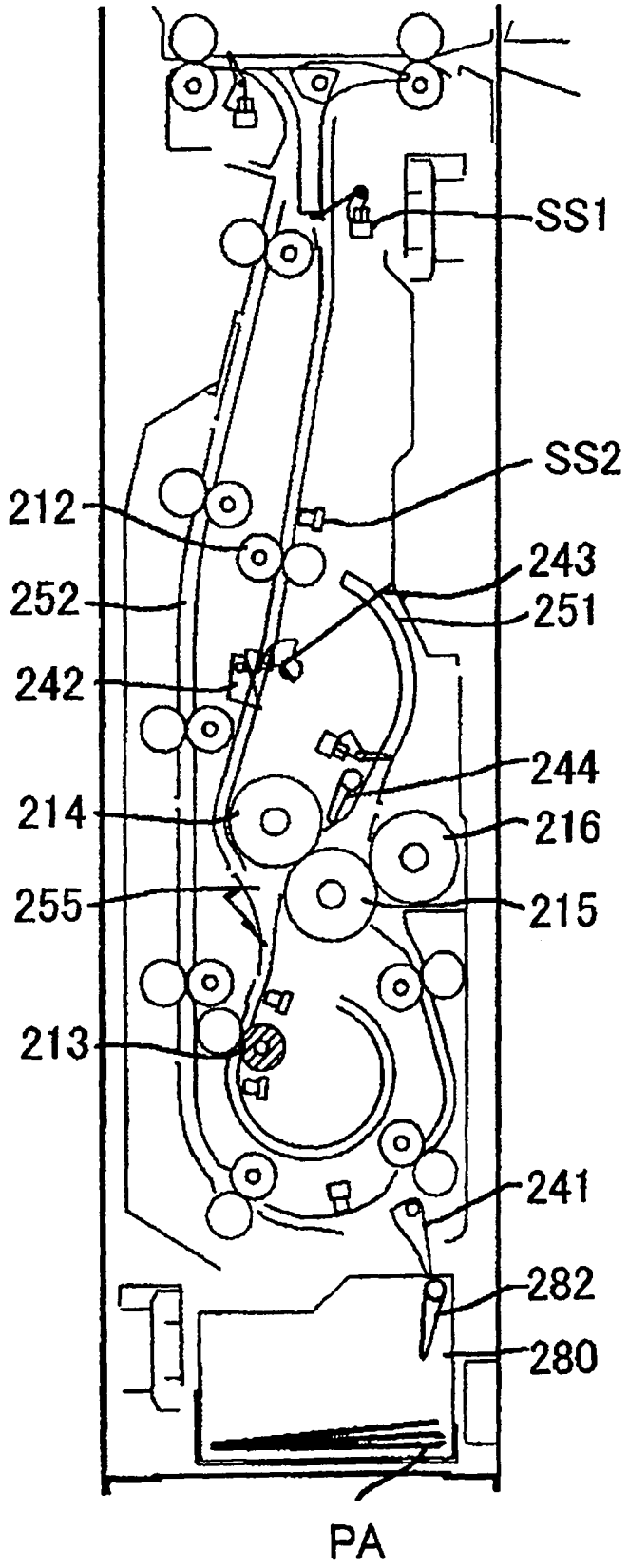
Figure 14A:
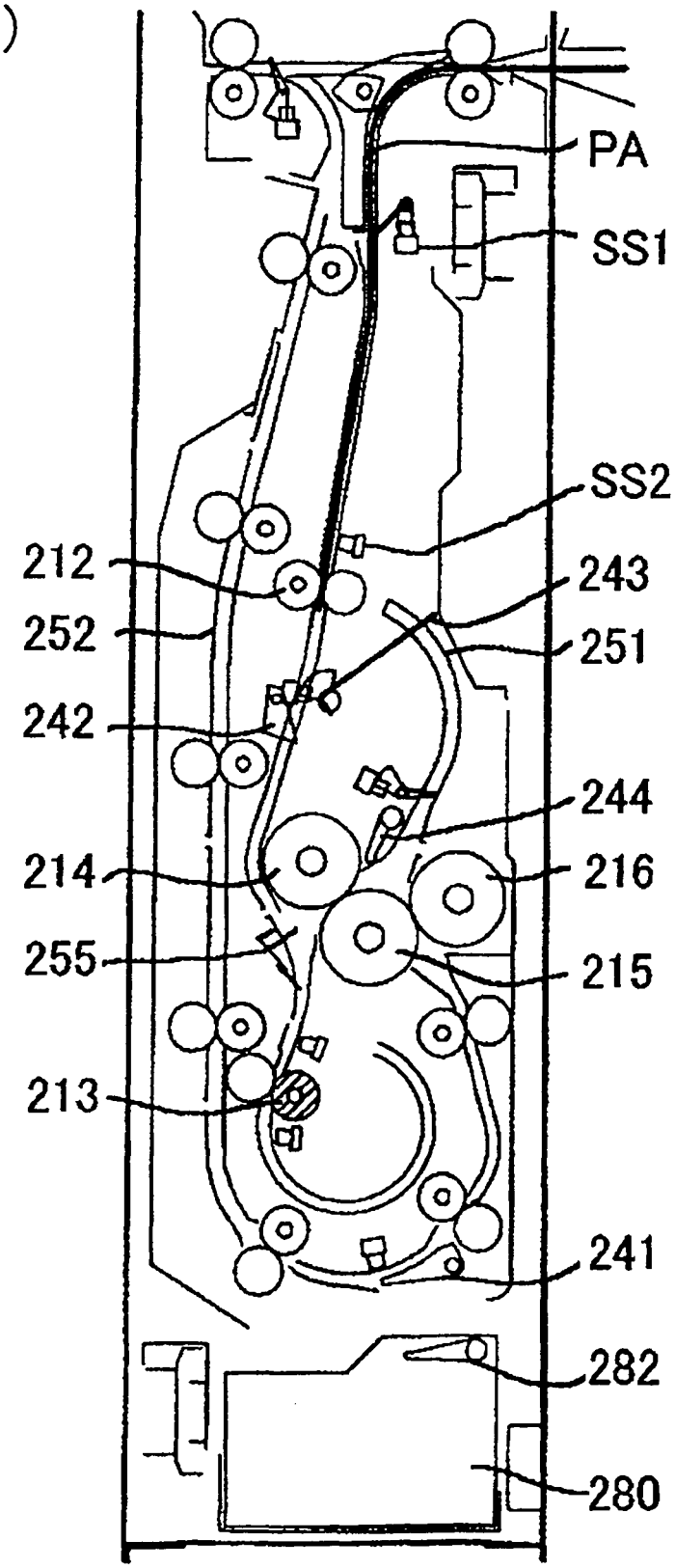
FIG. 14(*a*) is a view of the flow of operations for an accordion fold, and illustrates a first step in a first accordion folding format.
Figure 14B:
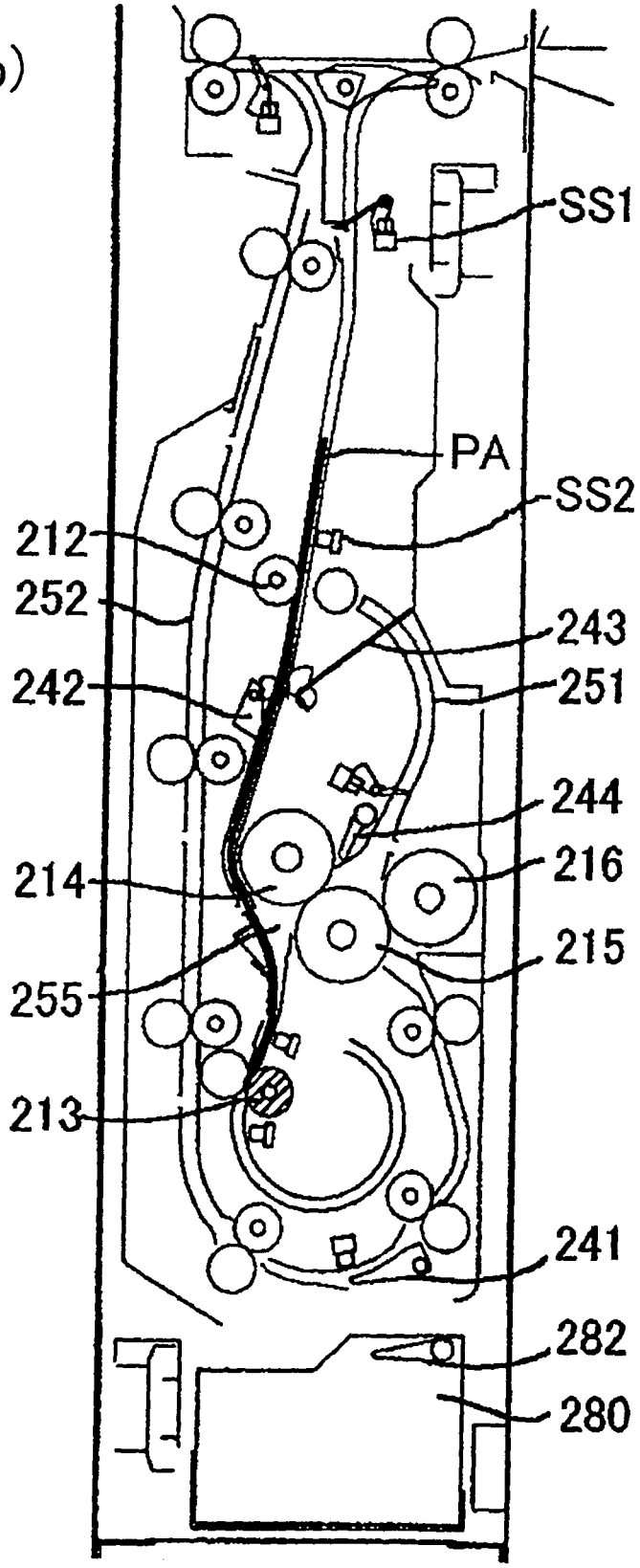
Figure 14C:
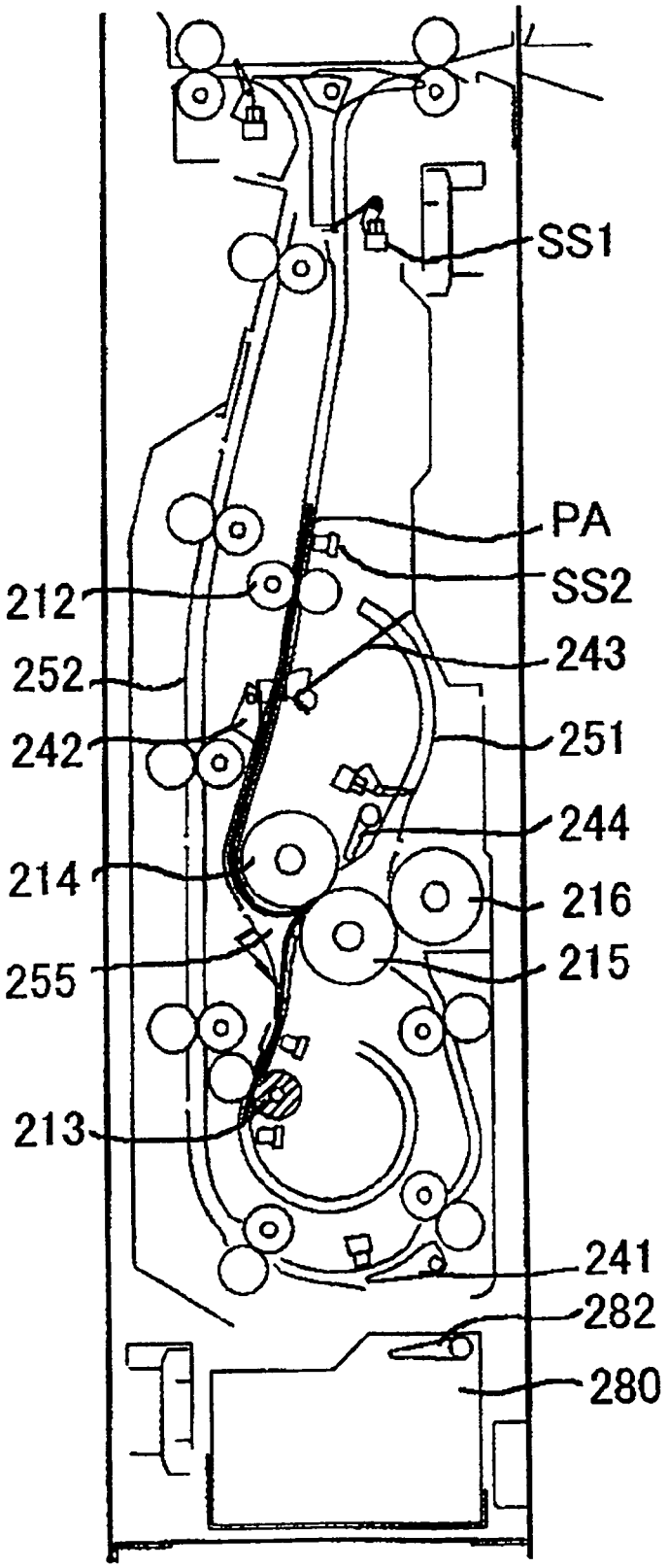
Figure 14D:
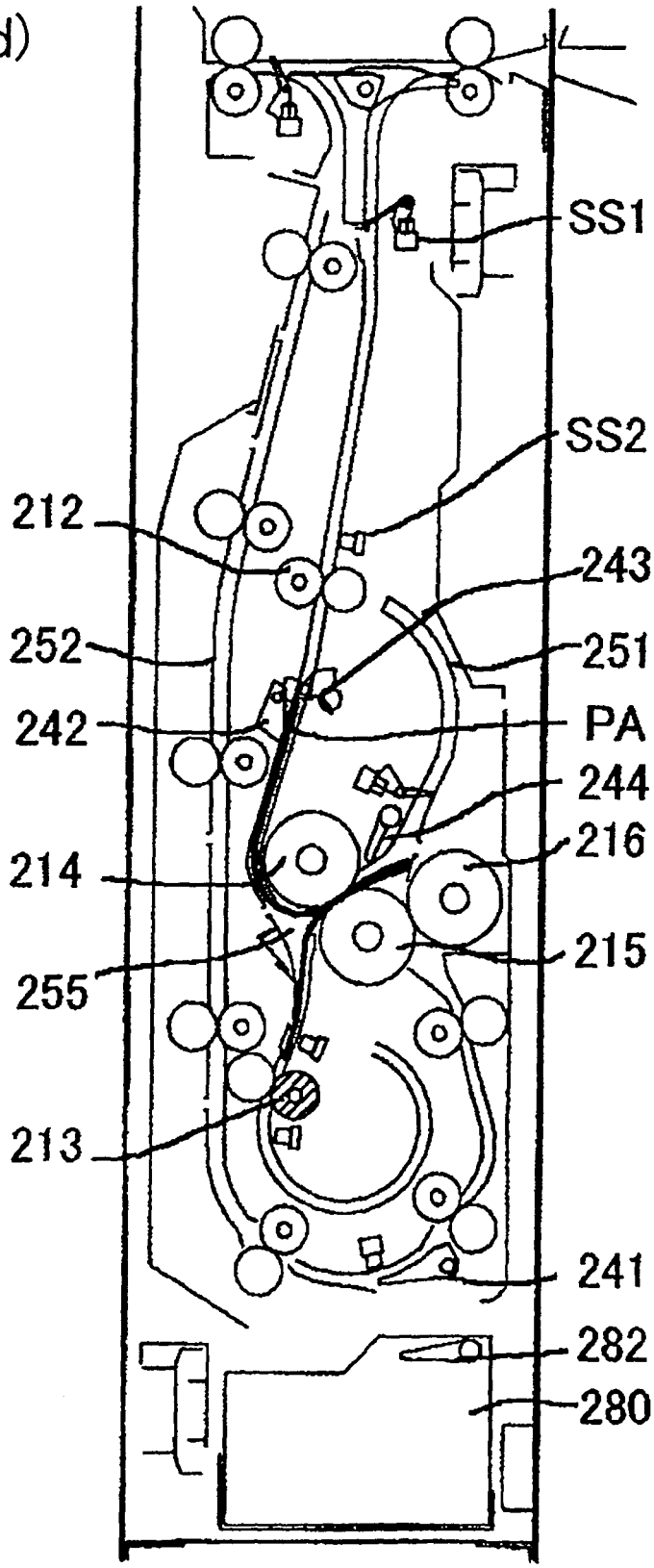
Figure 14E:
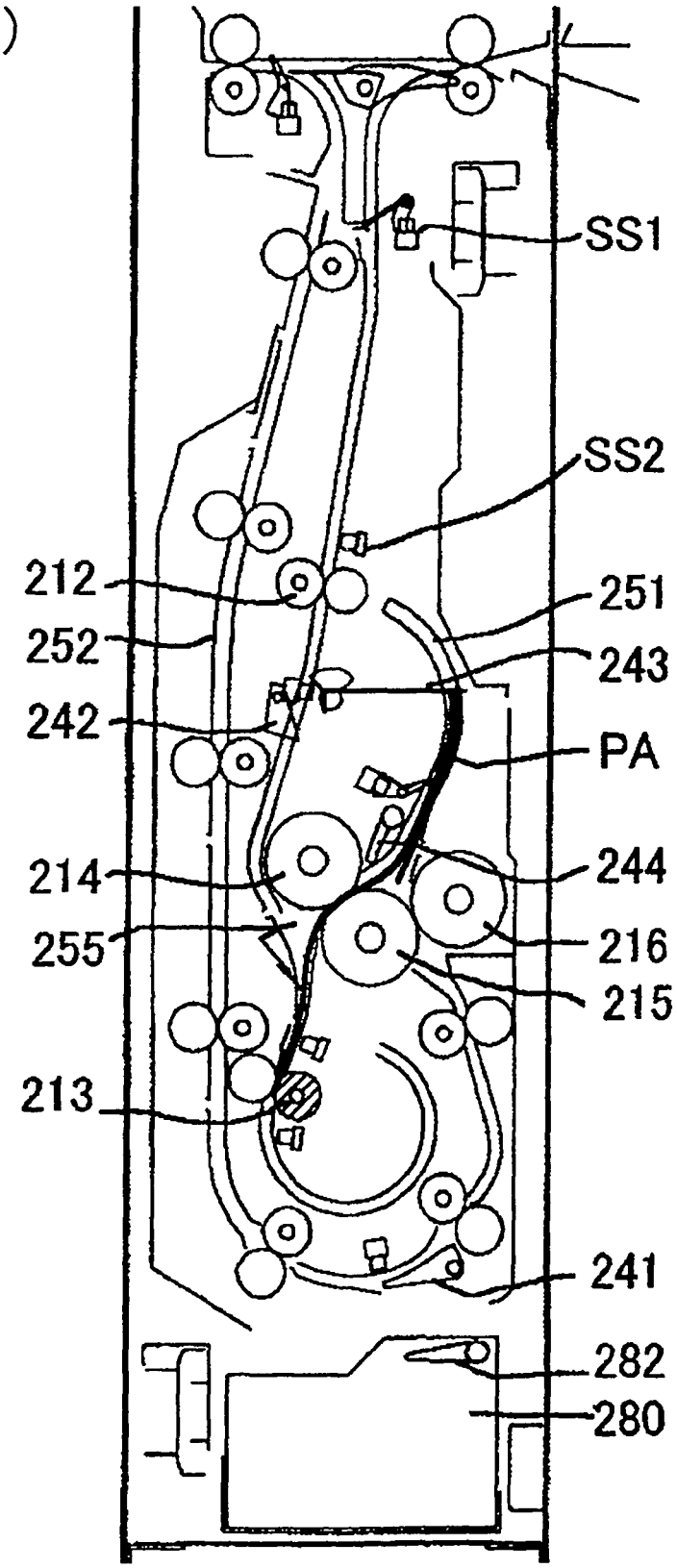
Figure 14F:
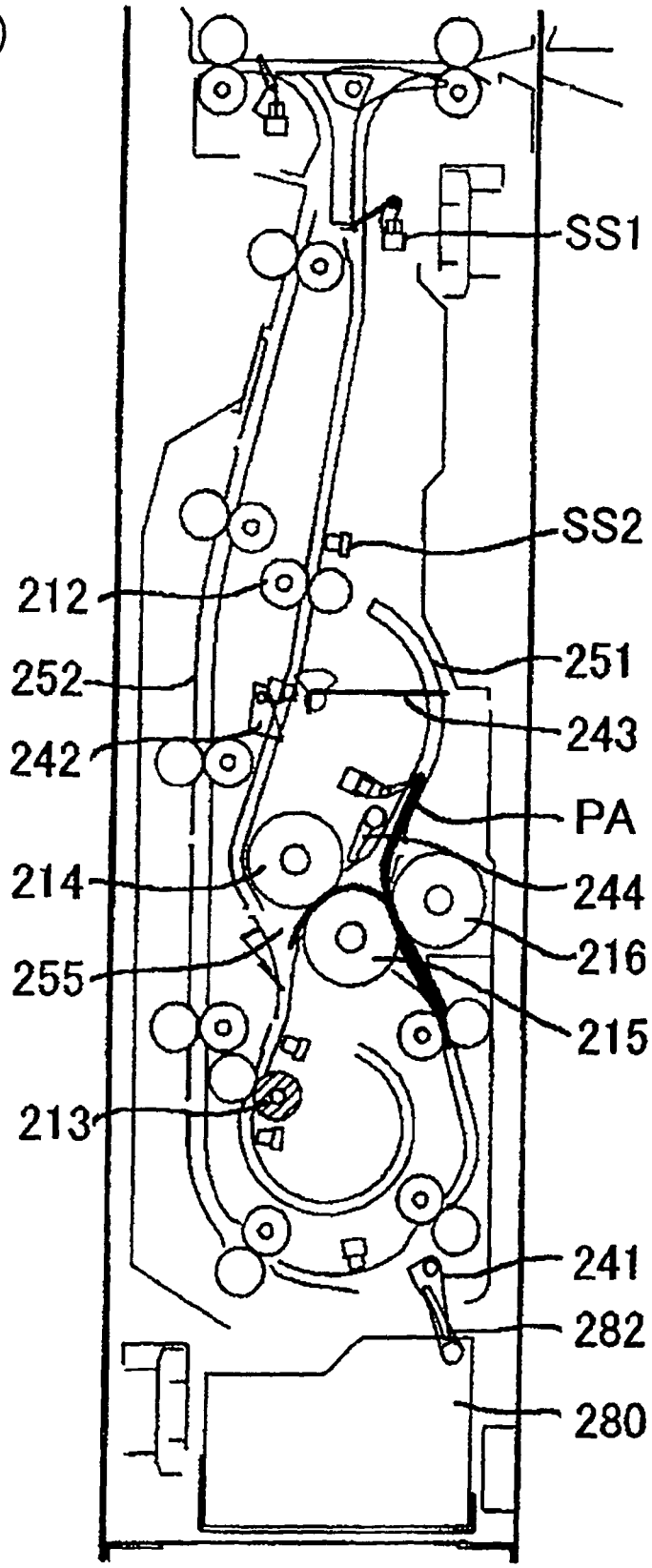
Figure 14G:
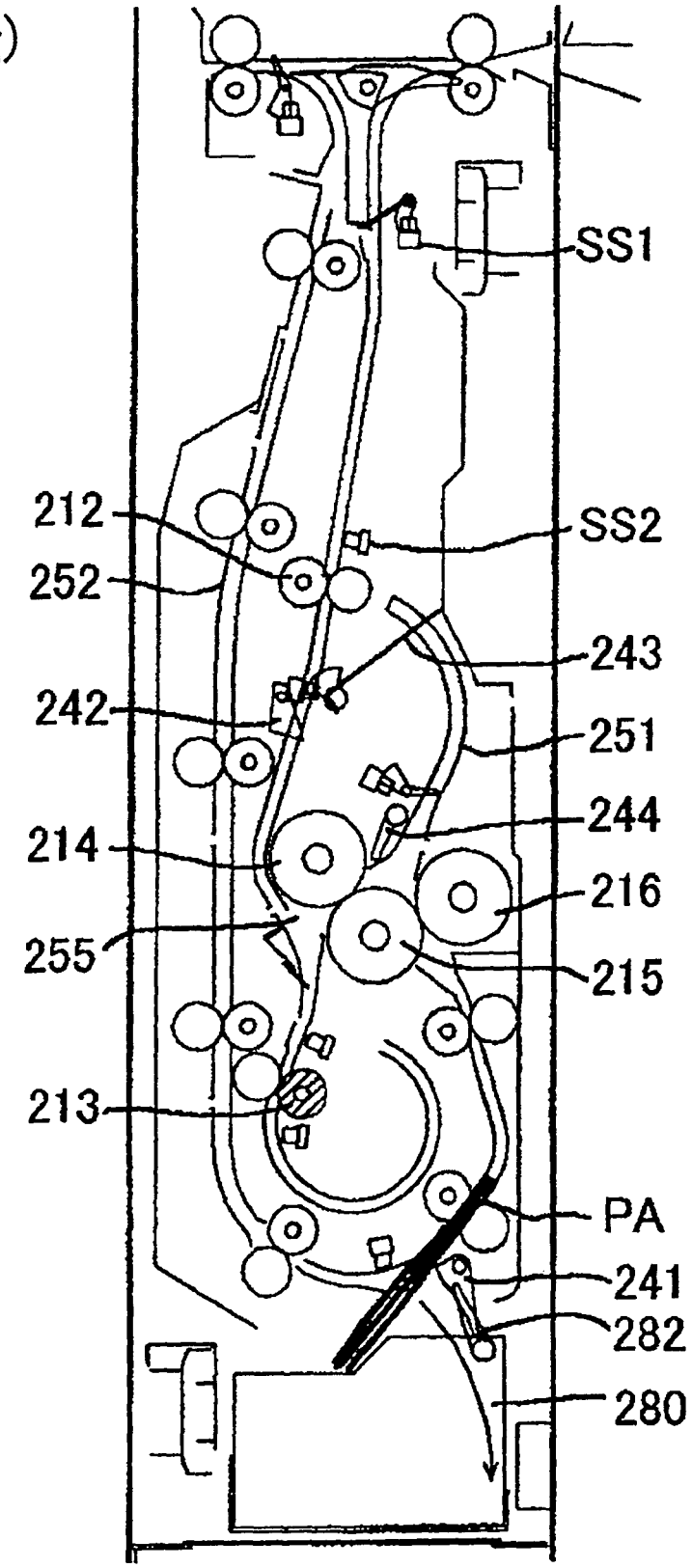
Figure 14H:
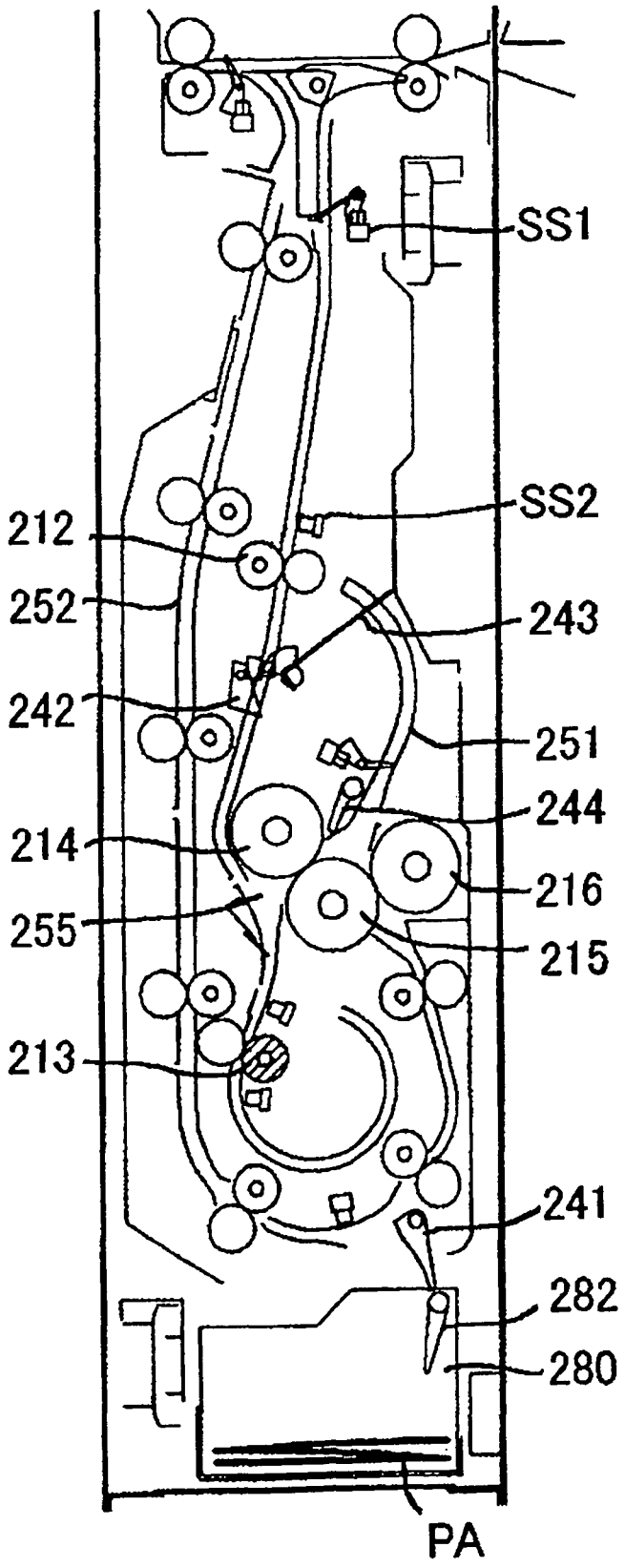
Figure 15A:
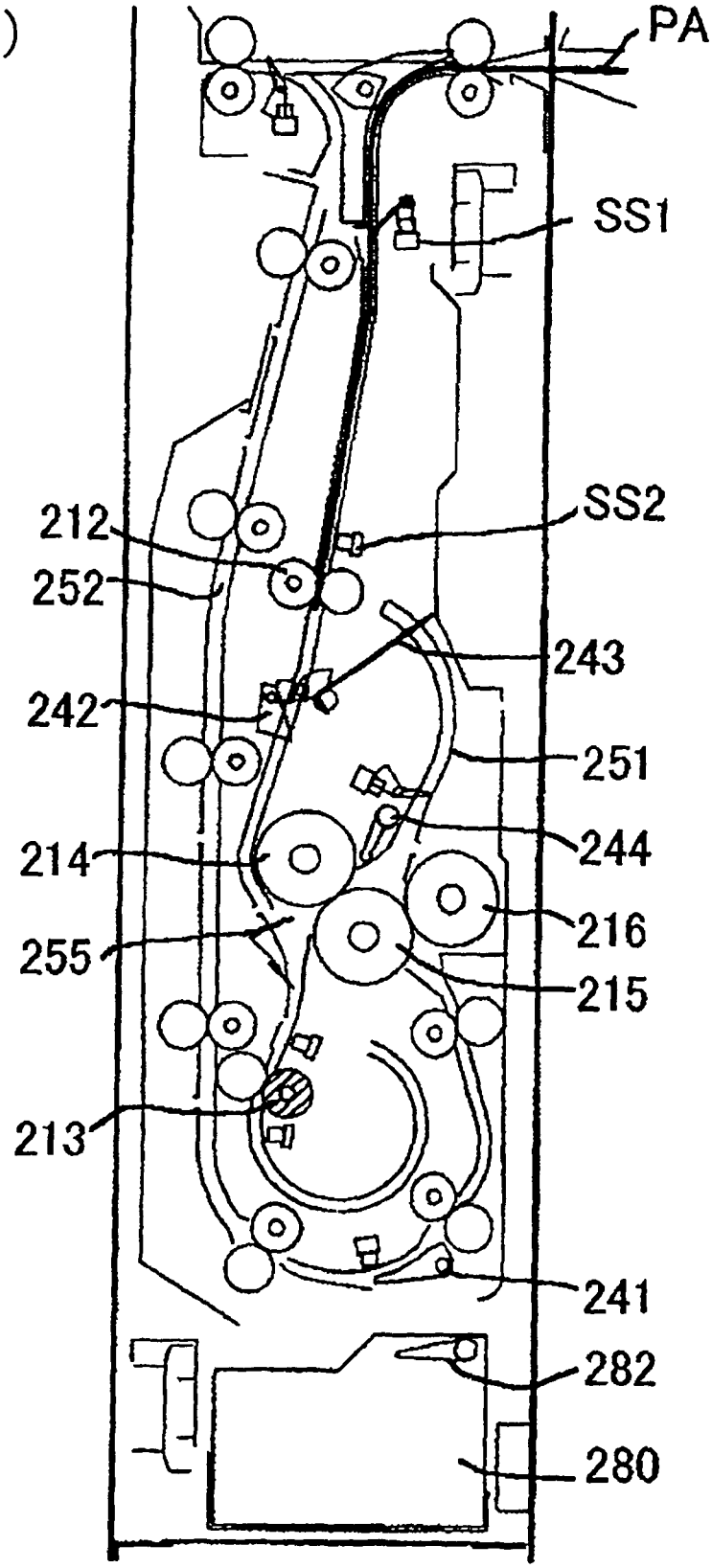
FIG. 15(*a*) is a view of the flow of operations for a double parallel, or gate, fold, and illustrates a first step in a first double parallel folding format.
Figure 15B:
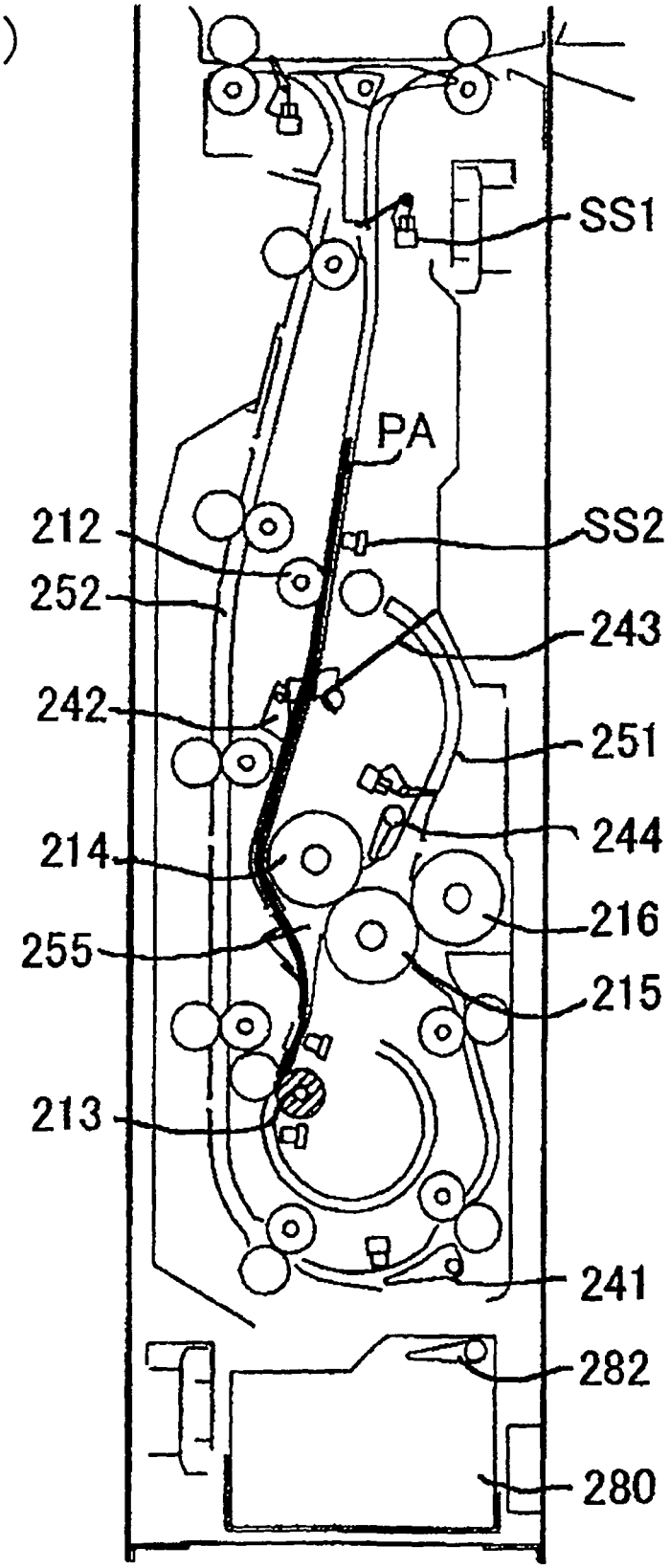
Figure 15C:
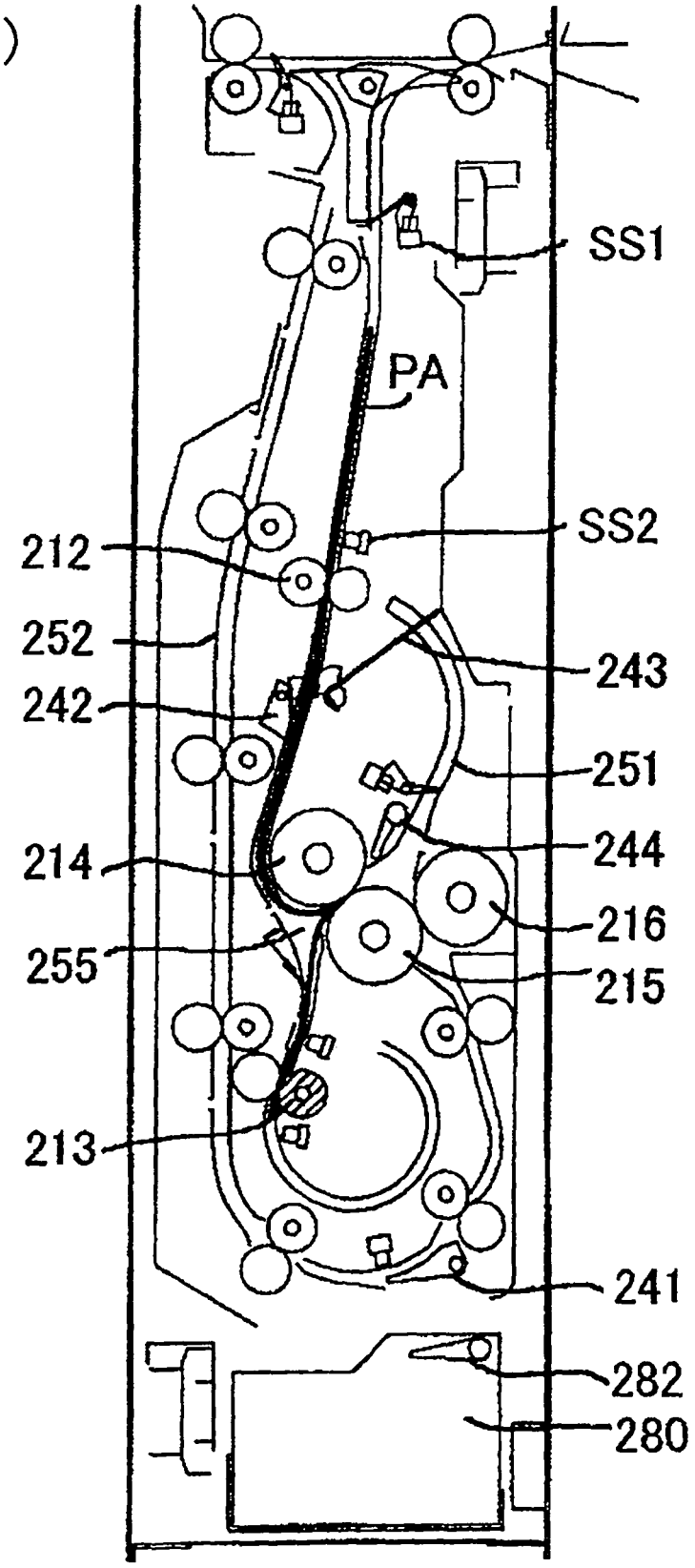
Figure 15D:
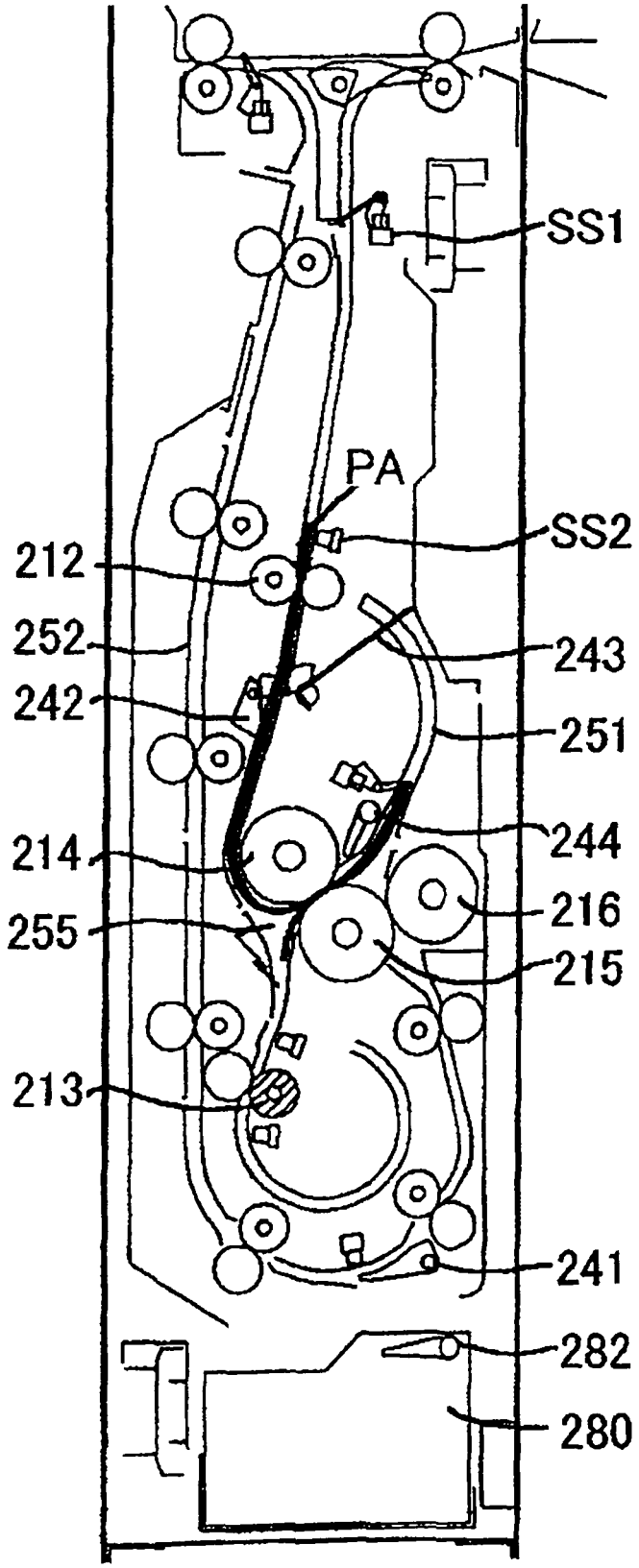
Figure 15E:
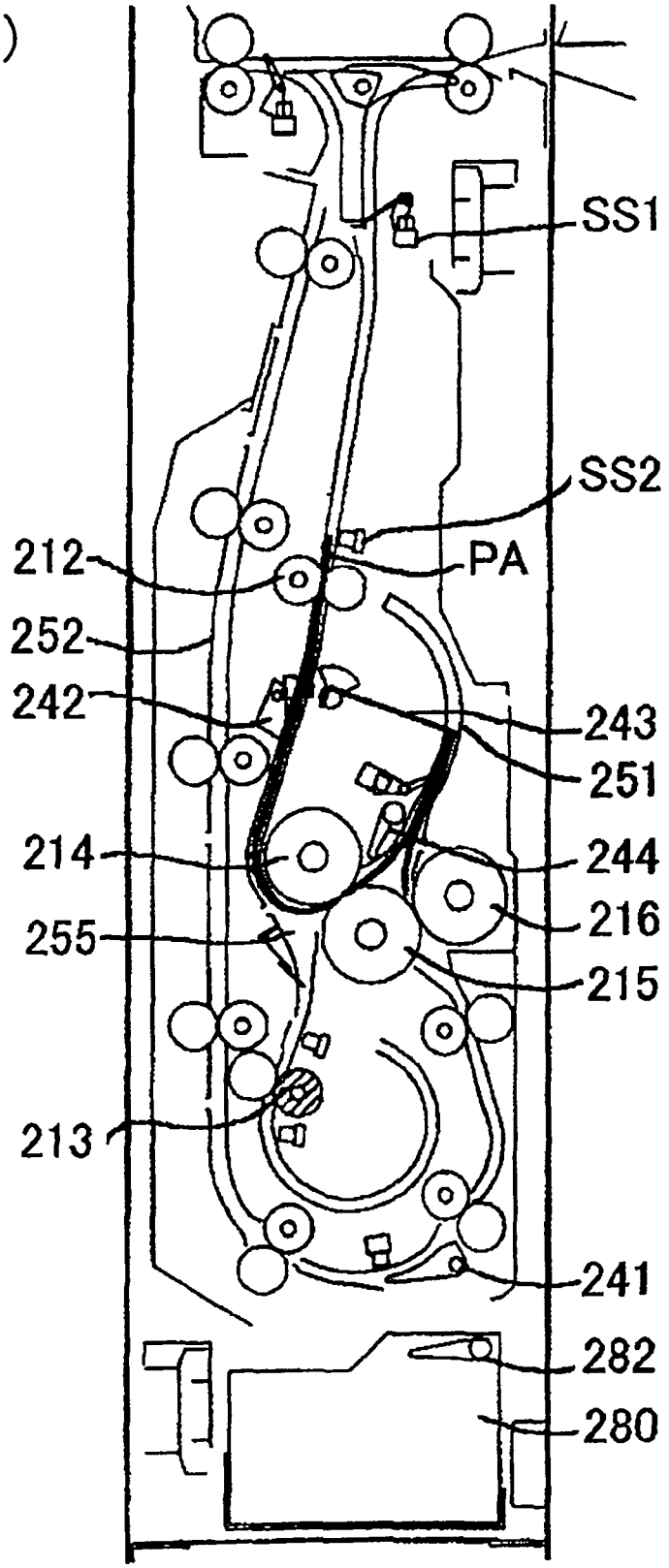
Figure 15F:
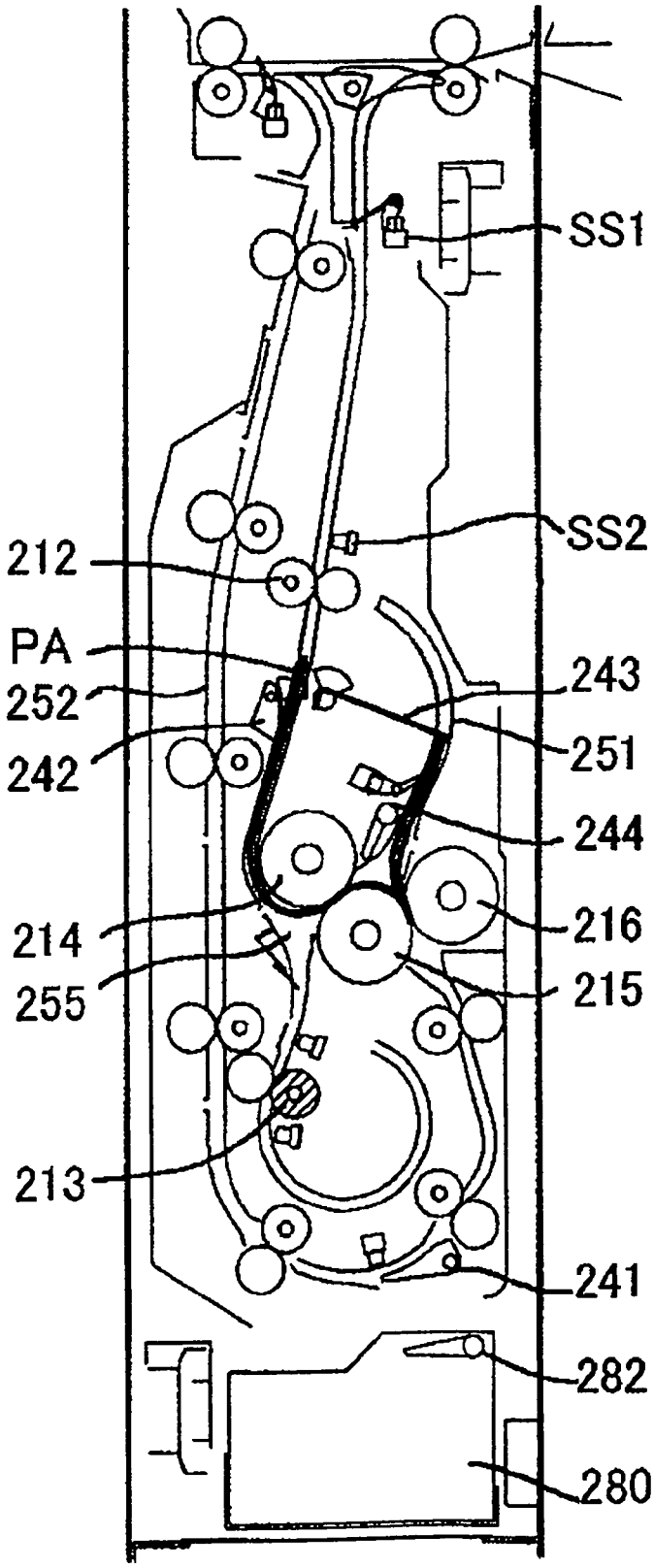
Figure 15G:
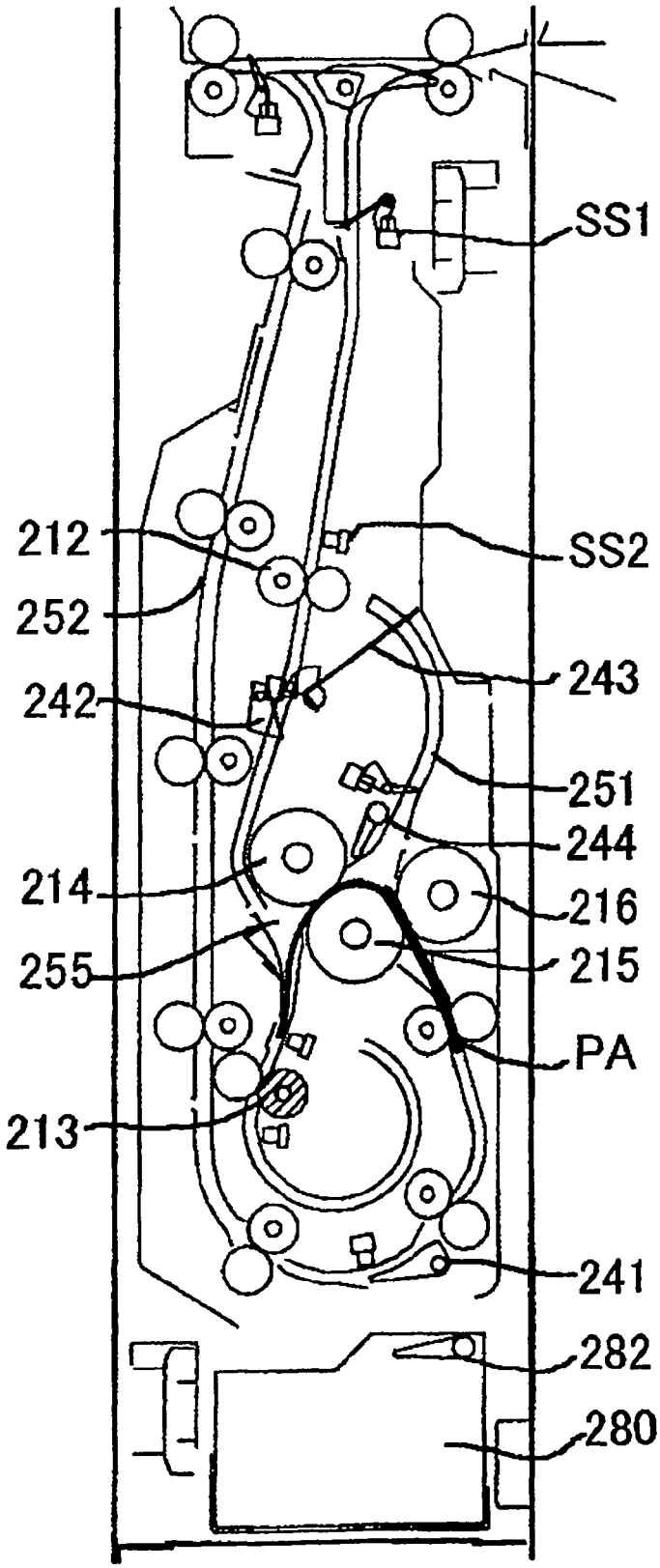
Figure 15H:
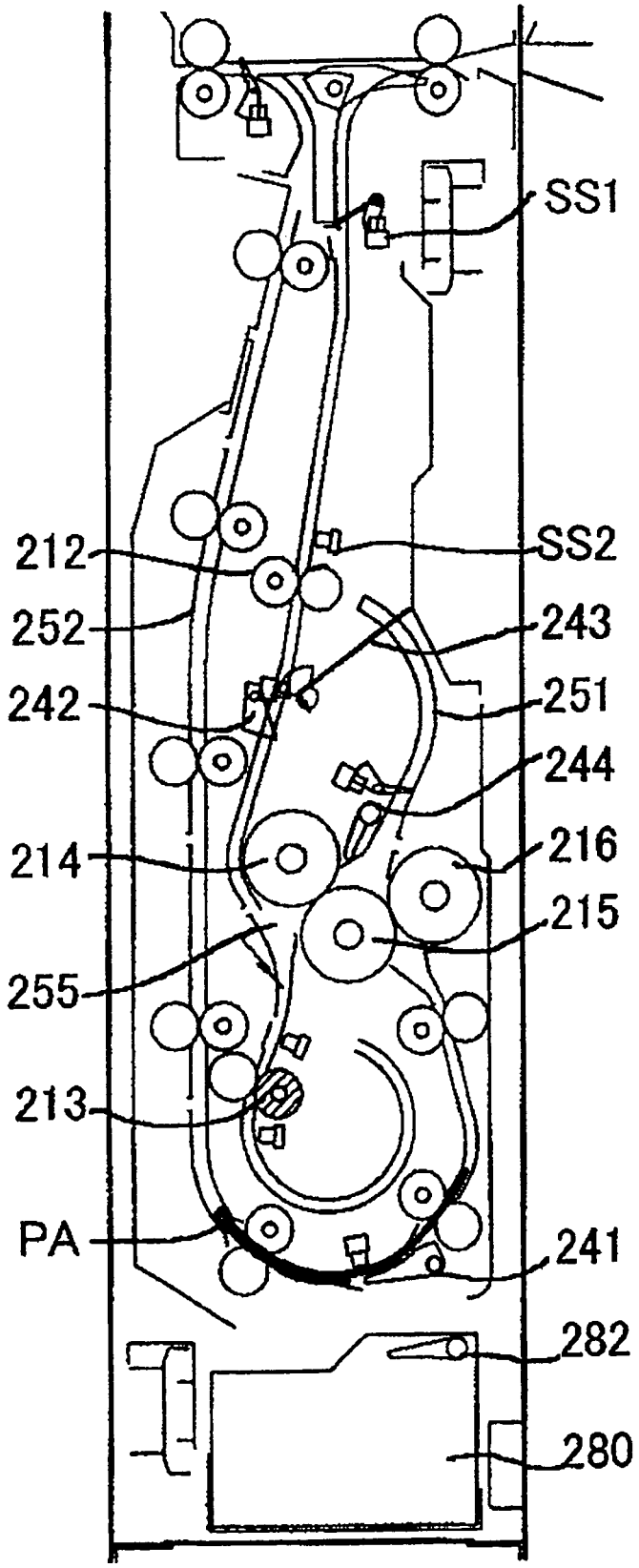
Figure 15I:
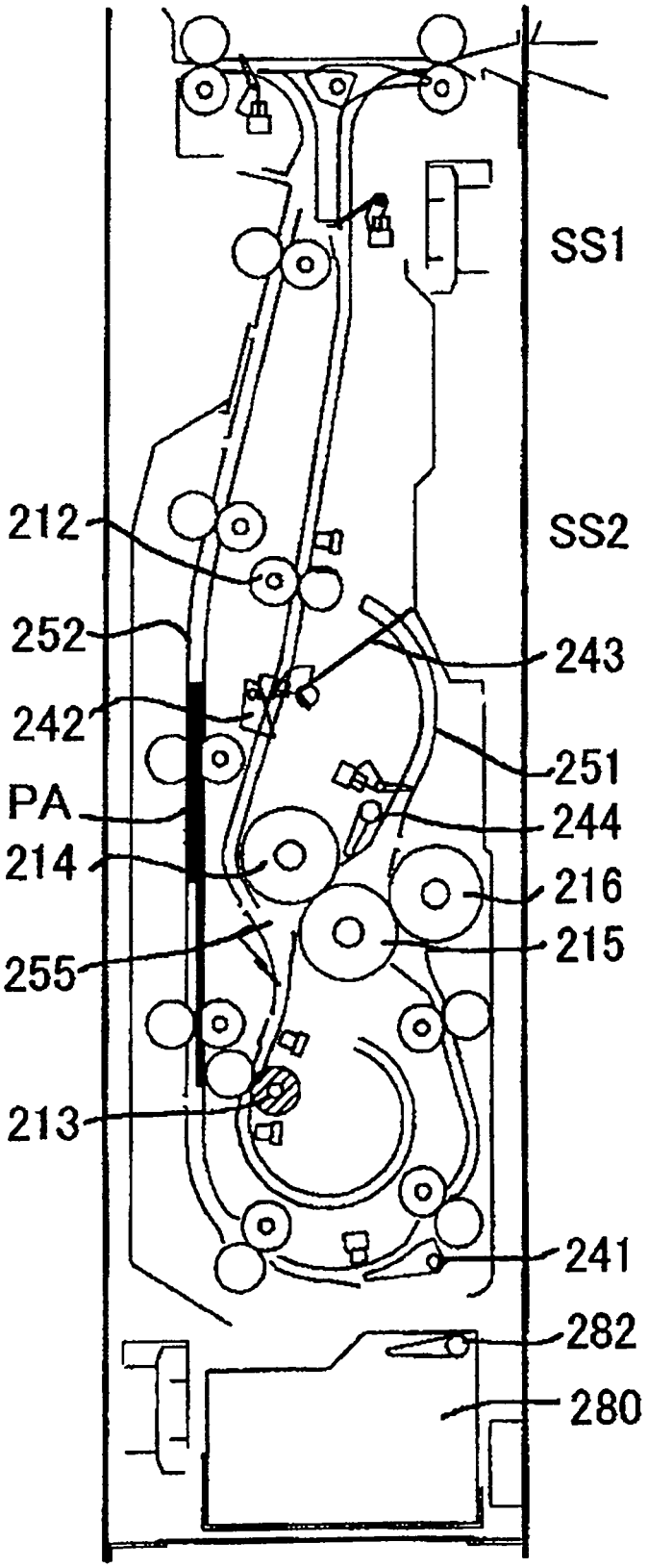
Figure 15J:
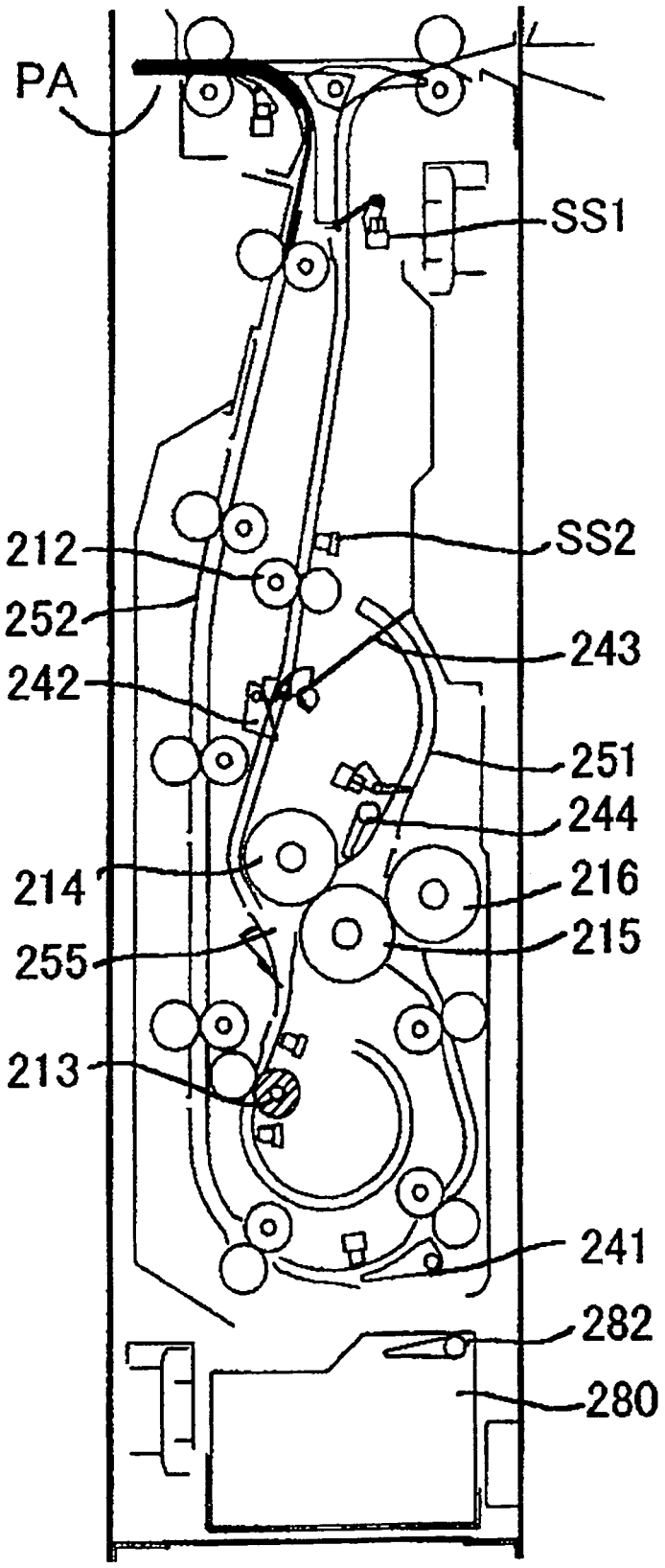

The following describes the configuration of the folded sheet storage box full detection mechanism with reference to FIG. 12.

A folded sheet pressing flapper 282 is fastened and supported by a flapper shaft 283 matingly supported to rotate on the folded sheet storage box wall above the folded sheet storage box 280. A rack 286 is arranged on a back surface at the backside of the folded sheet storage box. The movement of the rack 286 rotates a flapper gear 284 supported by a parallel pin on the flapper shaft 283 via the pinion gear 287 so as to rotate the folded sheet pressing flapper 282 to touch the surface of the sheets. When stacking a sheet, the leading edge of a sheet at an opposite side of the fold of a folded sheet is positioned at the flapper 282 shaft side. The leading edge of the sheet has a tendency to flap open at the top surface of the stack. In such a case, the sheet pressing flapper 282 rotates in the counterclockwise direction at the sheet end side from the folded side so as to eliminate the effect of the flapping of the open end of the sheet. The parallel pin groove of the flapper gear 284 has some play in the direction of rotation. To absorb this play, a flapper gear spring 285 is embedded. The gear spring 285 prevents bending of the folded sheet pressing flapper 282 when it is in contact with the surface of stacked sheets.

Flapper solenoid SL7 is arranged on a device frame (frame not shown), in opposition to a back surface at a backside of the folded sheet storage box 280. When the flapper solenoid SL7 is turned ON, the rack is moved by the flapper SOL lever to rotate the folded sheet pressing flapper 282, thereby enabling it to detect when the folded sheet storage box 280 is full. A sensor mask plate 289 is fastened to the flapper shaft 283, and the full detection sensor SS7 is opposingly arranged. To detect that the folded sheet storage box 280 is full, the full detection sensor interrupts the sensor light. The sheet pressing flapper 282 is mounted on a side that presses against the free end of the sheets.

Paper Folding Unit Operation

The following describes the various paper folding unit operations, with emphasis on the paper folding process, with reference to FIGS. 13(*a*) to 15(*j*).

As a basic operation, a sheet discharged from the main unit undergoes one of the folding processes described above (i.e., the letter fold, the accordion fold, or the double parallel, or gate, fold) according to a folding mode specified when a paper folding mode has been instructed.

Initial Operations

The power to the main unit is turned ON, thereby turning ON the power to the paper folding unit. The status of the actuators such as the sensors and solenoids is compared to initial preset values. The comparison is communicated to the main unit, and if necessary, the paper folding unit is initialized. At the same time as the initial checks described above, the drives of the conveyance motor M1 and the paper folding drive motor M2 are started.

Loading Paper

When a sheet is conveyed from the main unit to the sheet conveyance inlet 210 of the paper folding unit 200, a discharge signal ES, a size signal DS, and the folding mode signal FS are input from the CPU on the main unit to the paper folding unit control unit 290 of the paper folding unit 200. An input conveyance gate 240 located directly behind the sheet conveyance inlet of the paper folding unit guides the sheet to the first conveyance path 250 inside the paper folding unit according to the input information.

Paper Registration

The sheet PA conveyed into the first conveyance path 250 is monitored during the conveyance by the inlet sensor SS1, and the path sensor SS2. The sheet PA is further conveyed by the input conveyance roller 212, and the leading edge of the sheet is detected by the pre-registration sensor SS3. After the pre-registration sensor SS3 turns ON, and the leading edge of the sheet engages the registration SB roller 213, the input conveyance roller 212 is driven further for a predetermined amount of time, thereby forming a loop in the sheet at the conveyance path. The registration motor M3 is stopped in an energized state, and by turning the ratchet solenoid SL5 of the clutch ON, the registration SB roller is held in place.

After the loop is formed in the sheet, the pressure solenoid SL3 is turned OFF and the separating solenoid SL2 is turned ON thereby separating the pressing contact of the pinch roller 233 with the input conveyance roller 212. This provides some freedom to the sheet PA. Any skewing in the sheet is corrected based on the contact line (or the nipping line) of the pinch roller SB 234 that opposes the registration SB roller 213, thereby completing the registration process of the sheet PA.

Paper Folding Process

After the registration process has been completed, a process based on the specified paper folding information is applied in the following way when the system enters the paper folding process.

Letter Fold Process (see FIGS. 13(*a*) to 13(*h*))

After any skewing of the sheet PA has been removed, the separating solenoid SL2 turns OFF so that the pinch-roller 233 comes into contact with the input conveyance roller 212 again, thereby feeding the sheet PA with the forward drive of the registration motor M3 (see FIG. 13 (*a*)). During this drive, the ratchet solenoid SL5 of the clutch unit is turned ON, thereby securely transmitting the drive. The amount of conveyance of the sheet by the pulse motor is controlled by counting motor pulses. The registration motor M3 drives until the sheet trailing edge passes the sheet trailing edge stopper 242 at a position downstream in the conveyance path of the input conveyance roller 212 (see FIG. 13(*c*)). At that point, the registration motor M3 stops. The number of pulses is equivalent to the trailing edge of the sheet passing the sheet trailing edge stopper 242. The number of pulses is set according to the paper size and the paper folding mode. Pulses are counted at the point at which the leading edge of the sheet is detected by the post registration sensor SS4.

At the point that the trailing edge of the sheet passes the sheet trailing edge stopper 242, the registration motor M3 drives in the reverse direction with the ratchet solenoid SL5 still ON. The sheet PA is conveyed back where the trailing edge of the sheet engages the trailing edge stopper 242 thereby forming a loop at the folding 1 loop forming portion 255 (see FIG. 13(*d*)). The sheet PA is then nipped between the folding rollers following the roller surfaces of the first roller 214 and the second roller 215.

At a predetermined amount of time after the post registration sensor SS4 detects the edge of the sheet again when nippingly conveying the sheet by the two folding rollers 214 and 215, the ratchet solenoid SL5 and the registration motor M3 turn OFF. The registration SB roller 213 then follows the rotation of the folding rollers 214 and 215 so that no excessive amount of stress is applied to the sheet or the folding rollers. For the same reason, instead of disconnecting the drive transmission, it is also perfectly acceptable to separate the pinch roller SB 234 that is the companion to the registration SB roller 213.

Thus, the sheet PA is handed over to the first roller 214 and the second roller 215, the two folding rollers that mainly nippingly convey the sheet PA for the first folding process. The sheet PA is fed in a folded state with the folded portion as the leading end. The folded sheet detection sensor SS5 detects the leading edge, and the leading edge touches the folding reference stopper 243 that has moved and is set at a predetermined position disposed above the second conveyance path 251 downstream (see FIG. 13(*e*)). This creates another paper loop at the folding 2 loop forming portion.

Notably, because the paper edge that has undergone the first folding process comes to the paper loop side when creating a paper loop at the folding 2 loop forming portion 256 to create a letter fold, it is easy for the corners of the sheet edge to become caught and wrinkled when performing the second folding process. Therefore, in the letter folding process, after a predetermined amount of time has passed after the folded sheet detection sensor SS5 has detected the sheet, the pressing solenoid SL4 turns ON to activate the sheet pressing guide 244. The pressing guide 244 presses the edge surface of the sheet that has been folded once so as to prevent the corners from getting caught, wrinkled, or bent if the end of the sheet was flapping. In the same manner as in the first folding process, the sheet is nipped between the folding rollers, but follows the roller surface of the second roller 215 and the third roller 216 for the second folding process. In a folded state, the sheet is nipped by the conveyance roller 217 (see FIG. 13(*f*)), and the folded portion is pressed firmly thereby completing the letter folding process.

Accordion Fold Process (see FIGS. 14(*a*) to 14(*h*))

In the same manner as was described above in relation to the letter folding process, any skewing in the sheet PA is first corrected. Then, the pinch roller 233 comes into pressing contact with the input conveyance roller 212 (see FIG. 14(*a*)). The registration motor M3 drives in a forward direction to convey the sheet PA using the registration SB roller 213. At this time, the number of pulses of the motor is counted to determine the conveyance amount. The registration motor M3 then stops at a point equivalent to the paper length L ($\frac{1}{3}-\alpha$) in the direction of sheet PA conveyance.

The ratchet solenoid SL5 remains ON, but the registration motor M3 stops in an energized state. While the sheet PA is nipped by the registration SB roller 213 (see FIG. 14(*b*)), the pressure solenoid SL3 turns ON to increase the conveyance force. As the sheet PA is further conveyed by the input conveyance roller 212, a paper loop is formed at the folding 1 loop forming portion 255. The paper loop increases in size, so that sheet PA is nipped between the folding rollers, and the sheet PA follows the roller surfaces of the first roller 214 and the second roller 215 (see FIG. 14(*c*)). In this way, the first folding process is performed. At that time, so that no excessive stress is applied to the sheet or the folding rollers 214 and 215, the registration SB roller 213 follows the rotation, as described above in relation to the letter folding process. The pressure solenoid SL3 is turned OFF at the input conveyance roller 212 side.

After the first folding process, the sheet PA is fed in the same manner as in the letter folding process, i.e., in a folded state with the folded portion as the leading edge. The leading edge then touches the folding reference stopper 243 movingly set at a predetermined position so as to create a paper loop at the folding 2 loop forming portion 256. The folded edge of the sheet (i.e., the first folded edge) is on an opposite side, separating the paper loop of the folding 2 loop portion 256 and the sheet, so there is no need for concern that the sheet edge will become caught, as was the case in the letter folding process. So, there is no need for the sheet pressing guide 244 to be activated.

In the same manner as in the first folding process, the sheet is nipped between the folding rollers and follows the roller surface of the second roller 215 and the third roller 216, and the second folding process is performed (see FIG. 14(*f*)). In a folded state, the sheet is nipped by the conveyance roller 217 (see FIG. 14(*f*)), and the folded portion is firmly pressed, thereby completing the accordion folding process (see FIGS. 14(*g*) and (*h*)).

Double Parallel, or Gate, Fold Process (see FIGS. 15(*a*) to 15(*j*))

After any skewing in the sheet has been removed, the separating solenoid SL2 turns OFF so that the pinch roller 233 comes into contact with the input conveyance roller 212. The pressure solenoid SL3 turns ON and feeds the sheet PA by raising the conveyance force of the input conveyance roller 212 (see FIG. 15(*a*)). The registration motor M3 stops in an energized state, and the ratchet solenoid SL5 turns ON so that the registration SB roller 213 is held in place. The sheet PA is conveyed over the first conveyance path 250 by the input conveyance roller 212 and engages the stationary registration SB roller 213 thereby forming a paper loop at the folding 1 loop forming portion 255 (see FIG. 15(*b*)). At this time, so that no excessive stress is applied to the sheet, the registration SB roller 213 follows the rotation of the folding rollers in the same way as in the letter folding process. At a predetermined amount of time after pressing the pinch roller 233 into contact with the input conveyance roller 212 so as to transfer the sheet PA to the first roller 214 and the second roller 215, the pressure solenoid SL3 turns OFF at the input conveyance roller 212 side.

The paper loop increases in size, so that the sheet PA is nipped between the folding rollers and follows the roller surfaces of the first roller 214 and the second roller 215 (see FIG. 15(*c*)). Thus, the first folding process is performed. The conveyance path length up to the nipping point of the registration SB roller 213, the first roller 214, and the second roller 215 is equivalent to ¼ the paper length L in the direction of sheet PA conveyance. It is possible to fold at a position that is equivalent to ¼ of the length of the sheet PA.

At this time, the folding reference stopper 243 at a downstream side of the second conveyance path 251 moves to a position corresponding to the double parallel, or gate, folding process, and the folding portion of the conveyed sheet PA touches the stopper (see FIG. 15(*e*)). The conveyed sheet nipped between the two folding rollers 214 and 215 creates a paper loop at the folding 2 loop forming portion 256.

Then, in the same manner as in the first folding process, the second folding process is performed by the second roller 215 and the third roller 216 (see FIG. 15(*f*)). The sheet PA is then nipped by the conveyance roller 217 while folded (see FIG. 15(*g*)). The folded portion is pressed, thereby completing the double parallel, or gate, folding process.

The sheet PA is then handed over from the conveyance roller 217 to the conveyance roller 218 on the third conveyance path 252 after the folding process is completed (see FIG. 15(*h*)). The storage gate 241 is disposed immediately after the conveyance roller 218. The storage gate 241 selects a paper path after the folding process is completed. If the double parallel, or gate, folding process has been selected, the sheet PA is conveyed over the third conveyance path 252 without the storage gate 241 switching paths. The sheet then merges into the fourth conveyance path 253. The conveyance of the sheet PA is confirmed by the sheet discharge sensor SS8, and at the same time as the sheet discharge signal is issued from the paper folding unit control unit 290, the folded sheet PA is fed to the finishing unit 300, thereby completing the folding process.

For the sheet PA having undergone a paper folding process, excluding the double parallel, or gate, folding process, the storage gate solenoid SL6 turns ON to switch the storage gate 241 to the folded sheet storage box 280 side. Then, the folding unit discharge sensor SS6 detects the sheet PA, which is then stored in the folded sheet storage box 280, thus completing the folding process. The folded sheet storage box 280 has a full detection sensor SS7 for detecting that the stack is full.

Thus, as has been explained above, the present invention calculates folding positions at the first and second folding rollers sequentially arranged on the sheet conveyance path by nipping a predetermined position of a sheet by a conveyance roller capable of both forward and reverse drives arranged at the downstream side of the first folding roller. Therefore, it is possible to calculate the folding position with comparative stability of accuracy by stopping the rotation of rollers at a position corresponding to the length of a sheet. Furthermore, because it is possible to calculate the folding position by engaging the leading edge of a folded sheet at a stopper arranged at an upstream side of the second folding roller, there is no concern for crushing, causing wrinkles, or creasing the fold when a sheet is nipped by a pair of rollers.

Furthermore, because the first stopper means are disposed at the downstream side of the folding roller means, and the second stopper means are disposed at an upstream side of the folding roller means, and sheets are folded using the folding roller means arranged in a sheet conveyance path, the sheet is guided with the leading edge side as a reference at the first stopper means, and the sheet is guided with the trailing edge side as a reference at the second stopper means. Thus, it is possible to set the folding position to be calculated based on the sheet leading edge according to paper folding condition, such as the sheet folding procedures and the sheet length, or on the sheet trailing edge. This provides a system in which the differences in sheet sizes, or any possible error in conveyance amounts, will not affect a folding position.

The disclosure of Japanese Patent Application Nos. 2004-265850, 2004-265851, 2004-265852, and 2004-265853, all of which were filed on Sep. 13, 2004, are incorporated herein.

While the invention has been explained with reference to the specific embodiments of the invention, the explanation is illustrative, and the invention is limited only by the appended claims.

What is claimed is:

1. A sheet finishing apparatus comprising:

a housing, a storage device for storing a folded sheet, arranged at a bottom of the housing, a sheet conveyance inlet and a sheet conveyance outlet, which are disposed at an upper portion of the housing, a first conveyance path arranged substantially horizontally and connected to the sheet conveyance inlet and the sheet conveyance outlet, a second conveyance path arranged substantially vertically and branching from the first conveyance path, said second conveyance path guiding a sheet from the sheet conveyance inlet to the storage device, folding roller means, disposed adjacent the second conveyance path, for folding the sheet, and comprising a first roller, a second roller, and a third roller, and a sheet discharge path arranged substantially vertically parallel to the second conveyance path and guiding the folded sheet from the second conveyance path to the sheet conveyance outlet, wherein said second conveyance path includes a first guide path located at a lower side relative to the folding roller means and guiding a rear side of the sheet to be fed to the folding roller means, a second guide path located at an upper side relative to the folding roller means and guiding a front side of the folded sheet conveyed from the folding roller means, and a gate for selectively guiding the folded sheet from the second guide path to the storage device or the sheet discharge path, and wherein the first roller and the second roller are disposed to contact with each other and configured to execute a first folding of the sheet, and the second roller and the third roller contact with each other and configured to execute a second folding of the sheet.

2. A sheet finishing apparatus according to claim 1, wherein said first guide path is formed by a curved guide member, and said second conveyance path includes a curved portion guiding the folded sheet to the sheet discharge path along an outer periphery of the first guide path.

3. An image forming apparatus comprising:

an image forming unit for forming an image on a sheet;

a paper folding unit for folding said sheet discharged from a sheet discharge outlet of the image forming unit; and a finishing unit for finishing said folded sheet discharged from the sheet conveyance outlet by punching holes or stapling, wherein said paper folding unit is the sheet finishing apparatus according to claim 1.

4. A sheet finishing apparatus according to claim 1, further comprising a folded sheet conveyance path communicating with the first, second and third roller so that the sheet folded by the first and second rollers is transferred to the folded sheet conveyance path and the folded sheet in the folded sheet conveyance path is transferred to the second and third rollers.

5. A sheet finishing apparatus according to claim 4, wherein the folded sheet conveyance path communicated with the sheet discharge path so that the sheet passing between the second and third rollers is transferred to the sheet discharge path.

6. A sheet finishing apparatus, comprising:

a housing, a storage device for storing a folded sheet, arranged at a bottom of the housing, a sheet conveyance inlet and a sheet conveyance outlet, which are disposed at an upper portion of the housing, a first conveyance path arranged substantially horizontally and connected to the sheet conveyance inlet and the sheet conveyance outlet, a second conveyance path arranged substantially vertically and branching from the first conveyance path, said second conveyance path guiding a sheet from the sheet conveyance inlet to the storage device, folding roller means, disposed adjacent the second conveyance path, for folding the sheet, and comprising a first roller, a second roller, and a third roller, a sheet discharge path arranged substantially vertically parallel to the second conveyance path and guiding the folded sheet from the second conveyance path to the sheet conveyance outlet, and a folded sheet conveyance path communicating with the first, second and third rollers so that the sheet folded by the first and second rollers is transferred to the folded sheet conveyance path and the folded sheet in the folded sheet conveyance path is transferred to the second and third rollers, wherein said second conveyance path includes a first guide path located at a lower side relative to the folding roller means and guiding a rear side of the sheet to be fed to the folding roller means, a second guide path located at an upper side relative to the folding roller means and guiding a front side of the folded sheet conveyed from the folding roller means, and a gate for selectively guiding the folded sheet from the second guide path to the storage device or the sheet discharge path, wherein the first roller and the second roller are disposed to contact with each other and configured to execute a first folding of the sheet, and the second roller and the third roller contact with each other and configured to execute a second folding of the sheet, wherein the folded sheet conveyance path communicates with the sheet discharge path so that the sheet passing between the second and third roller is transferred to the sheet discharge path, and wherein the sheet discharge path extends upwardly from a bottom where the storage device is located and connected to the first conveyance path.

* * * * *